US008579033B1

(12) United States Patent
Robichaux et al.

(10) Patent No.: US 8,579,033 B1
(45) **Date of Patent: *Nov. 12, 2013**

(54) ROTATING AND RECIPROCATING SWIVEL APPARATUS AND METHOD WITH THREADED END CAPS

(75) Inventors: Kip M. Robichaux, Houma, LA (US); Terry G. Robichaux, Houma, LA (US)

(73) Assignee: Mako Rentals, Inc., Houma, LA (US)

( * ) Notice: Subject to any disclaimer, the term of this patent is extended or adjusted under 35 U.S.C. 154(b) by 255 days.

This patent is subject to a terminal disclaimer.

(21) Appl. No.: 13/086,828

(22) Filed: Apr. 14, 2011

Related U.S. Application Data

(63) Continuation-in-part of application No. 12/942,411, filed on Nov. 9, 2010, now Pat. No. 8,118,102, which is a continuation of application No. 11/745,899, filed on May 8, 2007, now Pat. No. 7,828,064.

(60) Provisional application No. 60/890,068, filed on Feb. 15, 2007, provisional application No. 60/798,515, filed on May 8, 2006, provisional application No. 61/324,536, filed on Apr. 15, 2010.

(51) Int. Cl.
*E21B 7/12* (2006.01)

(52) U.S. Cl.
USPC ..... 166/351; 166/339; 166/345; 166/352

(58) Field of Classification Search
USPC ..... 166/339, 345, 351, 352, 358, 367, 85.1, 166/85.5, 78.1, 241.6; 175/5, 7, 10
See application file for complete search history.

(56) References Cited

U.S. PATENT DOCUMENTS

| | | | |
|---|---|---|---|
| 1,831,956 | A | 11/1931 | Harrington |
| 2,126,007 | A | 8/1938 | Guiberson et al. |
| 2,170,916 | A | 8/1939 | Schweitzer et al. |
| 2,243,340 | A | 5/1941 | Hild |
| 2,243,439 | A | 5/1941 | Pranger at al. |
| 2,609,836 | A | 9/1952 | Knox |
| 2,620,037 | A | 12/1952 | McClendon |
| 2,630,179 | A | 3/1953 | Brown |
| 2,760,795 | A | 8/1956 | Vertson |
| 3,329,221 | A | 7/1967 | Walker |
| 3,517,739 | A | 6/1970 | Rowley |
| 3,587,734 | A | 6/1971 | Shaffer et al. |
| 3,682,243 | A | 8/1972 | Bauer et al. |

(Continued)

FOREIGN PATENT DOCUMENTS

| | | |
|---|---|---|
| WO | WO 2004/018832 | 3/2004 |
| WO | WO 2006/060788 | 6/2006 |

*Primary Examiner* — Matthew Buck
*Assistant Examiner* — Aaron Lembo
(74) *Attorney, Agent, or Firm* — Garvey, Smith, Nehrbass & North, L.L.C.; Brett A. North

(57) ABSTRACT

What is provided is a method and apparatus wherein a swivel can be detachably connected to an annular blowout preventer while the drill string is being rotated and/or reciprocated. In one embodiment the sleeve or housing can be rotatably and sealably connected to a mandrel. The swivel can be incorporated into a drill or well string and enabling string sections both above and below the sleeve to be rotated in relation to the sleeve. In one embodiment the drill or well string does not move in a longitudinal direction relative to the swivel. In one embodiment, the drill or well string does move longitudinally relative to the sleeve or housing of the swivel.

16 Claims, 18 Drawing Sheets

(56) References Cited

U.S. PATENT DOCUMENTS

| | | | | | |
|---|---|---|---|---|---|
| 3,765,485 | A | | 10/1973 | Regan | |
| 3,779,313 | A | | 12/1973 | Regan | |
| 3,805,894 | A | | 4/1974 | Giroux | |
| 4,098,341 | A | | 7/1978 | Lewis | |
| 4,128,127 | A | | 12/1978 | Taylor | |
| 4,154,448 | A | | 5/1979 | Biffle | |
| 4,157,186 | A | | 6/1979 | Murray et al. | |
| 4,208,056 | A | | 6/1980 | Biffle | |
| 4,246,967 | A | | 1/1981 | Harris | |
| 4,312,404 | A | | 1/1982 | Morrow | |
| 4,363,357 | A | | 12/1982 | Hunter | |
| 4,398,599 | A | | 8/1983 | Murray | |
| 4,401,164 | A | | 8/1983 | Baugh | |
| 4,406,333 | A | | 9/1983 | Adams | |
| 4,416,340 | A | | 11/1983 | Bailey | |
| 4,418,947 | A | | 12/1983 | Talafuse | |
| 4,441,551 | A | | 4/1984 | Biffle | |
| 4,448,255 | A | | 5/1984 | Shaffer et al. | |
| 4,466,487 | A | | 8/1984 | Taylor, Jr. | |
| 4,480,703 | A | | 11/1984 | Garrett | |
| 4,486,025 | A | | 12/1984 | Johnston | |
| 4,496,006 | A | | 1/1985 | Smith | |
| 4,500,094 | A | | 2/1985 | Biffle | |
| 4,524,832 | A | | 6/1985 | Roche et al. | |
| 4,526,243 | A | | 7/1985 | Young | |
| 4,527,425 | A | | 7/1985 | Stockton | |
| 4,529,035 | A | | 7/1985 | Bayh, III | |
| 4,529,210 | A | | 7/1985 | Biffle | |
| 4,531,580 | A | | 7/1985 | Jones | |
| 4,606,417 | A | | 8/1986 | Webb et al. | |
| 4,626,135 | A | | 12/1986 | Roche | |
| 4,745,970 | A | | 5/1988 | Bearden et al. | |
| 4,754,820 | A | | 7/1988 | Watts et al. | |
| 4,783,084 | A | | 11/1988 | Biffle | |
| 4,848,475 | A | * | 7/1989 | Dean et al. | 166/357 |
| 4,856,414 | A | | 8/1989 | Churkin et al. | |
| 4,903,764 | A | | 2/1990 | Gleditsch | |
| 4,913,239 | A | | 4/1990 | Bayh, III | |
| 5,022,472 | A | | 6/1991 | Bailey et al. | |
| 5,137,084 | A | | 8/1992 | Gonzales et al. | |
| 5,178,215 | A | | 1/1993 | Yenulis et al. | |
| 5,184,686 | A | | 2/1993 | Gonzalez | |
| 5,213,158 | A | | 5/1993 | Bailey et al. | |
| 5,224,557 | A | | 7/1993 | Yenulis et al. | |
| 5,277,249 | A | | 1/1994 | Yenulis et al. | |
| 5,279,365 | A | | 1/1994 | Yenulis et al. | |
| 5,301,595 | A | | 4/1994 | Kessie | |
| 5,303,582 | A | | 4/1994 | Miska | |
| 5,322,137 | A | | 6/1994 | Gonzales | |
| 5,443,122 | A | | 8/1995 | Brisco | |
| 5,647,444 | A | | 7/1997 | Williams | |
| 5,662,181 | A | | 9/1997 | Williams et al. | |
| 5,727,640 | A | | 3/1998 | Gleditsch | |
| 5,848,643 | A | | 12/1998 | Carbaugh et al. | |
| 5,971,077 | A | * | 10/1999 | Lilley | 166/368 |
| 5,992,527 | A | * | 11/1999 | Garnham et al. | 166/379 |
| 5,996,712 | A | | 12/1999 | Boyd | |
| 6,039,118 | A | | 3/2000 | Carter et al. | |
| 6,039,325 | A | | 3/2000 | Steinetz et al. | |
| 6,070,670 | A | | 6/2000 | Carter et al. | |
| 6,102,673 | A | | 8/2000 | Mott et al. | |
| 6,129,152 | A | | 10/2000 | Hosie et al. | |
| 6,138,774 | A | | 10/2000 | Bourgoyne, Jr. et al. | |
| 6,202,764 | B1 | | 3/2001 | Ables et al. | |
| 6,230,557 | B1 | | 5/2001 | Ciglenec et al. | |
| 6,230,824 | B1 | | 5/2001 | Peterman et al. | |
| 6,244,345 | B1 | | 6/2001 | Helms | |
| 6,263,982 | B1 | | 7/2001 | Hannegan et al. | |
| 6,321,846 | B1 | | 11/2001 | Rytlewski | |
| 6,419,015 | B1 | | 7/2002 | Budde et al. | |
| 6,470,975 | B1 | | 10/2002 | Bourgoyne et al. | |
| 6,513,590 | B2 | | 2/2003 | Allamon et al. | |
| 6,530,430 | B2 | | 3/2003 | Reynolds | |
| 6,698,520 | B2 | * | 3/2004 | Fenton et al. | 166/347 |
| 6,739,395 | B2 | | 5/2004 | Reynolds | |
| 6,904,970 | B2 | | 6/2005 | Simson | |
| 6,988,553 | B2 | * | 1/2006 | DeBerry | 166/347 |
| 7,007,753 | B2 | | 3/2006 | Robichaux et al. | |
| 7,159,669 | B2 | | 1/2007 | Bourgoyne et al. | |
| 7,331,396 | B2 | * | 2/2008 | Reimert et al. | 166/368 |
| 7,828,064 | B2 | * | 11/2010 | Robichaux et al. | 166/358 |
| 8,066,076 | B2 | * | 11/2011 | Donald et al. | 166/344 |
| 8,118,102 | B2 | * | 2/2012 | Robichaux et al. | 166/345 |
| 2001/0011593 | A1 | * | 8/2001 | Wilkins | 166/368 |
| 2002/0070026 | A1 | * | 6/2002 | Fenton et al. | 166/368 |
| 2005/0115715 | A1 | | 6/2005 | Howlett | |
| 2005/0121198 | A1 | * | 6/2005 | Andrews | 166/368 |
| 2006/0180312 | A1 | | 8/2006 | Bracksieck et al. | |
| 2010/0300700 | A1 | * | 12/2010 | Garbett et al. | 166/368 |
| 2012/0273214 | A1 | * | 11/2012 | Donald et al. | 166/344 |

* cited by examiner

ROTATING AND RECIPROCATING SWIVEL APPARATUS AND METHOD WITH THREADED END CAPS

CROSS-REFERENCE TO RELATED APPLICATIONS

This is a continuation-in-part of U.S. patent application Ser. No. 12/942,411, filed Nov. 9, 2010 (now U.S. Pat. No. 8,118,102), which application was continuation of U.S. patent application Ser. No. 11/745,899, filed May 8, 2007 (now U.S. Pat. No. 7,828,064), which application is a non-provisional of both U.S. provisional patent application Ser. No. 60/890,068, filed on Feb. 15, 2007 and Ser. No. 60/798,515, filed on May 8, 2006. This is a non-provisional of U.S. Provisional Patent Application Ser. No. 61/324,536, filed Apr. 15, 2010, which is incorporated herein by reference.

Patent Cooperation Treaty Patent Application serial number PCT/US2008/072335, with international filing date of Aug. 6, 2008 (WIPO publication no. WP 2009/021037 A2), is incorporated herein by reference.

Provisional Patent Application Ser. No. 60/954,234, filed 6 Aug. 2007, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

In deepwater drilling rigs, marine risers extending from a wellhead fixed on the ocean floor have been used to circulate drilling fluid or mud back to a structure or rig. The riser must be large enough in internal diameter to accommodate a drill string or well string that includes the largest bit and drill pipe that will be used in drilling a borehole. During the drilling process drilling fluid or mud fills the riser and wellbore.

It is contemplated that the term drill string or well string as used herein includes a completion string and/or displacement string. It is believed that rotating and/or reciprocating the drill string or well string (e.g., completion string) during the displacement and/or frac processes helps such processes.

There is a need to allow rotation and/or reciprocating during displacement and/or frac jobs while the annular blow out preventor is closed on the drill, completion, and/or displacement string.

BRIEF SUMMARY

The method and apparatus of the present invention solves the problems confronted in the art in a simple and straightforward manner.

One embodiment relates to a method and apparatus for deepwater rigs. In particular, one embodiment relates to a method and apparatus for removing or displacing working fluids in a well bore and riser.

In one embodiment displacement is contemplated in water depths in excess of about 5,000 feet (1,524 meters).

One embodiment provides a method and apparatus having a swivel which can operably and/or detachably connect to an annular blowout preventer thereby separating the fluid into upper and lower sections.

In one embodiment a swivel can be used having a sleeve or housing that is rotatably and sealably connected to a mandrel. The swivel can be incorporated into a drill or well string.

In one embodiment the sleeve or housing can be fluidly sealed to and/or from the mandrel.

In one embodiment the sleeve or housing can be fluidly sealed with respect to the outside environment.

In one embodiment the sealing system between the sleeve or housing and the mandrel is designed to resist fluid infiltration from the exterior of the sleeve or housing to the interior space between the sleeve or housing and the mandrel.

In one embodiment the sealing system between the sleeve or housing and the mandrel has a higher pressure rating for pressures tending to push fluid from the exterior of the sleeve or housing to the interior space between the sleeve or housing and the mandrel than pressures tending to push fluid from the interior space between the sleeve or housing and the mandrel to the exterior of the sleeve or housing.

In one embodiment a swivel having a sleeve or housing and mandrel is used having at least one flange, catch, or upset to restrict longitudinal movement of the sleeve or housing relative to the annular blow out preventer. In one embodiment a plurality of flanges, catches, or upsets are used. In one embodiment the plurality of flanges, catches, or upsets are longitudinally spaced apart with respect to the sleeve or housing.

In one embodiment, at least partly during the time the riser and well bore are separated into two volumetric sections, the drill or well string is reciprocated longitudinally during displacement of fluid. In one embodiment a reciprocation stroke of about 65.5 feet (20 meters) is contemplated. In one embodiment about 20.5 feet (6.25 meters) of the stroke is contemplated for allowing access to the bottom of the well bore. In one embodiment about 35, about 40, about 45, and/or about 50 feet (about 10.67, about 12.19, about 13.72, and/or about 15.24 meters) of the stroke is contemplated for allowing at least one pipe joint-length of stroke during reciprocation. In one embodiment reciprocation is performed up to a speed of about 20 feet per minute (6.1 meters per minute).

In one embodiment, at least partly during the time the riser and well bore are separated into two volumetric sections, the drill or well string is intermittently reciprocated longitudinally during displacement of fluid. In one embodiment the rotational speed is reduced during the time periods that reciprocation is not being performed. In one embodiment the rotational speed is reduced from about 60 revolutions per minute to about 30 revolutions per minute when reciprocation is not being performed.

In one embodiment, at least partly during the time the riser and well bore are separated into two volumetric sections, the drill or well string is continuously reciprocated longitudinally during displacement of fluid.

In one embodiment, at least partly during the time the riser and well bore are separated into two volumetric sections, the drill or well string is reciprocated longitudinally the distance of at least the length of one joint of pipe during displacement of fluid.

In one embodiment, at least partly during the time the riser and well bore are separated into two volumetric sections, the drill or well string is rotated during displacement of fluid. In one embodiment rotation of speeds up to 60 revolutions per minute are contemplated.

In one embodiment, at least partly during the time the riser and well bore are separated into two volumetric sections, the drill or well string is intermittently rotated during displacement of fluid.

In one embodiment, at least partly during the time the riser and well bore are separated into two volumetric sections, the drill or well string is continuously rotated during displacement of fluid of at least one of the volumetric sections.

In one embodiment, at least partly during the time the riser and well bore are separated into two volumetric sections, the drill or well string is alternately rotated during displacement of fluid during.

In one embodiment, at least partly during the time the riser and well bore are separated into two volumetric sections, the direction of rotation of the drill or well string is changed during displacement of fluid.

In various embodiments, at least partly during the time the riser and well bore are separated into two volumetric sections, the drill or well string is reciprocated longitudinally the distance of at least about 1 inch (2.54 centimeters), about 2 inches (5.08 centimeters), about 3 inches (7.62 centimeters), about 4 inches (10.16 centimeters), about 5 inches (12.7 centimeters), about 6 inches (15.24 centimeters), about 1 foot (30.48 centimeters), about 2 feet (60.96 centimeters), about 3 feet (91.44 centimeters), about 4 feet (1.22 meters), about 6 feet (1.83 meters), about 10 feet (3.048 meters), about 15 feet (4.57 meters), about 20 feet (6.096 meters), about 25 feet (7.62 meters), about 30 feet (9.14 meters), about 35 feet (10.67 meters), about 40 feet (12.19 meters), about 45 feet (13.72 meters), about 50 feet (15.24 meters), about 55 feet (16.76 meters), about 60 feet (18.29 meters), about 65 feet (19.81 meters), about 70 feet (21.34 meters), about 75 feet (22.86 meters), about 80 feet (24.38 meters), about 85 feet (25.91 meters), about 90 feet (27.43 meters), about 95 feet (28.96 meters), and about 100 feet (30.48 meters) during displacement of fluid and/or between the ranges of each and/or any of the above specified lengths.

In various embodiments, the height of the swivel's sleeve or housing compared to the length of its mandrel is between two and thirty times. Alternatively, between two and twenty times, between two and fifteen times, two and ten times, two and eight times, two and six times, two and five times, two and four times, two and three times, and two and two and one half times. Also alternatively, between 1.5 and thirty times, 1.5 and twenty times, 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

The rotating and reciprocating tool can be closed on by the annular blowout preventer ("annular BOP"). Typically, the annular BOP is located immediately above the ram BOP which ram BOP is located immediately above the sea floor and mounted on the well head. As an integral part of the string, the mandrel of the rotating and reciprocating tool supports the full weight, torque, and pressures of the entire string located below the mandrel.

Thrust Bearings

In one embodiment the rotating and reciprocating tool can include a thrust bearing on its pin end to allow free relative rotation between the mandrel and sleeve even where the completion string with mandrel is pulled up to (and possibly beyond) the upper stroke extent of the rotating and reciprocating tool. The closed annular BOP holds the sleeve rotationally fixed notwithstanding the mandrel being rotated and/or reciprocated and the bottom catch would limit upward movement of the sleeve within the annular BOP. If, for whatever reason, the operator, attempts to pull up the completion string/mandrel to the upper limit of the stroke between the sleeve and mandrel, the sleeve will be pulled up the annular BOP until its lower catch interacts with the annular BOP to prevent further upward movement of the sleeve. At this point a longitudinal thrust load between the sleeve and the mandrel will be created. The thrust bearing will absorb this thrust load while facilitating relative rotation between the sleeve and the mandrel (so that the sleeve can remain rotationally fixed relative to the annular BOP). Without the thrust bearing, frictional and/or other forces between the sleeve and the mandrel caused by the thrust load can cause the sleeve to start rotating along with the mandrel, and then relative to the annular BOP. Relative rotation between the sleeve and annular BOP is not desired as it can cause wear/damage to the annular BOP and/or the annular seal. In one embodiment this thrust bearing is an integral part of a clutch/latch/bearing assembly.

In one embodiment the rotating and reciprocating tool can include a thrust bearing on its box end to allow free relative rotation between the mandrel and sleeve even where the completion string with mandrel is pushed down to (and possibly beyond) the lower stroke extent of the rotating and reciprocating tool. The closed annular BOP holds the sleeve rotationally fixed notwithstanding the mandrel being rotated and/or reciprocated and the upper catch would limit downward movement of the sleeve within the annular BOP. If, for whatever reason, the operator, attempts to push down the completion string/mandrel to the lower limit of the stroke between the sleeve and mandrel, the sleeve will be pushed down the annular BOP until its upper catch interacts with the annular BOP to prevent further downward movement of the sleeve. At this point a longitudinal thrust load between the sleeve and the mandrel will be created. The thrust bearing will absorb this thrust load while facilitating relative rotation between the sleeve and the mandrel (so that the sleeve can remain rotationally fixed relative to the annular BOP). Without the thrust bearing, frictional and/or other forces between the sleeve and mandrel caused by the thrust load can cause the sleeve to start rotating along with the mandrel, and then relative to the annular BOP. Relative rotation between the sleeve and annular BOP is not desired as it can cause wear/damage to the annular BOP and/or the annular seal. In one embodiment, this thrust bearing is an outer thrust bearing.

Quick Lock/Quick Unlock

After the sleeve and mandrel have been moved relative to each other in a longitudinal direction, a downhole/underwater locking/unlocking system is needed to lock the sleeve in a longitudinal position relative to the mandrel (or at least restricting the available relative longitudinal movement of the sleeve and mandrel to a satisfactory amount compared to the longitudinal length of the sleeve's effective sealing area). Additionally, an underwater locking/unlocking system is needed which can lock and/or unlock the sleeve and mandrel a plurality of times while the sleeve and mandrel are underwater.

In one embodiment is provided a system wherein the underwater position of the longitudinal length of the sleeve's sealing area (e.g., the nominal length between the catches) can be determined with enough accuracy to allow positioning of the sleeve's effective sealing area in the annular BOP for closing on the sleeve's sealing area. After the sleeve and mandrel have been longitudinally moved relative to each other when the annular BOP was closed on the sleeve, it is preferred that a system be provided wherein the underwater position of the sleeve can be determined even where the sleeve has been moved outside of the annular BOP.

In one embodiment is provided a quick lock/quick unlock system for locating the relative position between the sleeve and mandrel. Because the sleeve can reciprocate relative to the mandrel (i.e., the sleeve and mandrel can move relative to each other in a longitudinal direction), it can be important to be able to determine the relative longitudinal position of the sleeve compared to the mandrel at some point after the sleeve has been reciprocated relative to the mandrel. For example, in various uses of the rotating and reciprocating tool, the operator may wish to seal the annular BOP on the sleeve sometime after the sleeve has been reciprocated relative to the mandrel and after the sleeve has been removed from the annular BOP.

To address the risk that the actual position of the sleeve relative to the mandrel will be lost while the tool is underwater, a quick lock/quick unlock system can detachably connect the sleeve and mandrel. In a locked state, this quick lock/quick unlock system can reduce the amount of relative longitudinal movement between the sleeve and the mandrel (compared to an unlocked state) so that the sleeve can be positioned in the annular BOP and the annular BOP relatively easily closed on the sleeve's longitudinal sealing area. Alternatively, this quick lock/quick unlock system can lock in place the sleeve relative to the mandrel (and not allow a limited amount of relative longitudinal movement). After being changed from a locked state to an unlocked state, the sleeve can experience its unlocked amount of relative longitudinal movement.

In one embodiment is provided a quick lock/quick unlock system which allows the sleeve to be longitudinally locked and/or unlocked relative to the mandrel a plurality of times when underwater. In one embodiment the quick lock/quick unlock system can be activated using the annular BOP.

In one embodiment the sleeve and mandrel can rotate relative to one another even in both the activated and un-activated states. In one embodiment, when in a locked state, the sleeve and mandrel can rotate relative to each other. This option can be important where the annular BOP is closed on the sleeve at a time when the string (of which the mandrel is a part) is being rotated. Allowing the sleeve and mandrel to rotate relative to each other, even when in a locked state, minimizes wear/damage to the annular BOP caused by a rotationally locked sleeve (e.g., sheer pin) rotating relative to a closed annular BOP. Instead, the sleeve can be held fixed rotationally by the closed annular BOP, and the mandrel (along with the string) rotate relative to the sleeve.

In one embodiment, when the locking system of the sleeve is in contact with the mandrel, locking/unlocking is performed without relative rotational movement between the locking system of the sleeve and the mandrel—otherwise scoring/scratching of the mandrel at the location of lock can occur. In one embodiment, this can be accomplished by rotationally connecting to the sleeve the sleeve's portion of quick lock/quick unlock system. In one embodiment a locking hub is provided which is rotationally connected to the sleeve.

In one embodiment a quick lock/quick unlock system on the rotating and reciprocating tool can be provided allowing the operator to lock the sleeve relative to the mandrel when the rotating and reciprocating tool is downhole/underwater. Because of the relatively large amount of possible stroke of the sleeve relative to the mandrel (i.e., different possible relative longitudinal positions), knowing the relative position of the sleeve with respect to the mandrel can be important. This is especially true at the time the annular BOP is closed on the sleeve. The locking position is important for determining relative longitudinal position of the sleeve along the mandrel (and therefore the true underwater depth of the sleeve) so that the sleeve can be easily located in the annular BOP and the annular BOP closed/sealed on the sleeve.

During the process of moving the rotating and reciprocating tool underwater and downhole, the sleeve can be locked relative to the mandrel by a quick lock/quick unlock system. In one embodiment the quick lock/quick unlock system can, relative to the mandrel, lock the sleeve in a longitudinal direction. In one embodiment the sleeve can be locked in a longitudinal direction with the quick lock/quick unlock system, but the sleeve can rotate relative to the mandrel during the time it is locked in a longitudinal direction. In one embodiment the quick lock/quick unlock system can simultaneously lock the sleeve relative to the mandrel, in both a longitudinal direction and rotationally. In one embodiment the quick lock/quick unlock system can relative to the mandrel, lock the sleeve rotationally, but at the same time allow the sleeve to move longitudinally.

General Method Steps

In one embodiment the method can comprise the following steps:

(a) lowering the rotating and reciprocating tool to the annular BOP, the tool comprising a sleeve and mandrel;

(b) after step "a", having the annular BOP close on the sleeve;

(c) after step "b", causing relative longitudinal and/or rotational movement between the sleeve and the mandrel while the annular BOP is closed on the sleeve;

(d) during step "c", performing a frac job.

In one embodiment the following additional steps are performed:

(e) after step "c", moving the sleeve outside of the annular BOP;

(f) after step "e", moving the sleeve inside of the annular BOP and having the annular BOP close on the sleeve;

(g) after step "f", causing relative longitudinal movement between the sleeve and the mandrel.

In one embodiment, during step "a", the sleeve is longitudinally locked relative to the mandrel.

In one embodiment, after step "b", the sleeve is unlocked longitudinally relative to the mandrel.

In one embodiment, after step "c", the sleeve is longitudinally locked relative to the mandrel.

In one embodiment, during step "c" operations are performed in the wellbore.

In one embodiment, during step "g" operations are performed in the wellbore.

In one embodiment, longitudinally locking the sleeve relative to the mandrel shortens an effective stroke length of the sleeve from a first stroke to a second stroke.

In one embodiment, during step "a", the mandrel can freely rotate relative to the sleeve.

In one embodiment, after step "b", the mandrel can freely rotate relative to the sleeve.

In one embodiment, after step "c", the mandrel can freely rotate relative to the sleeve.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Figure 1:
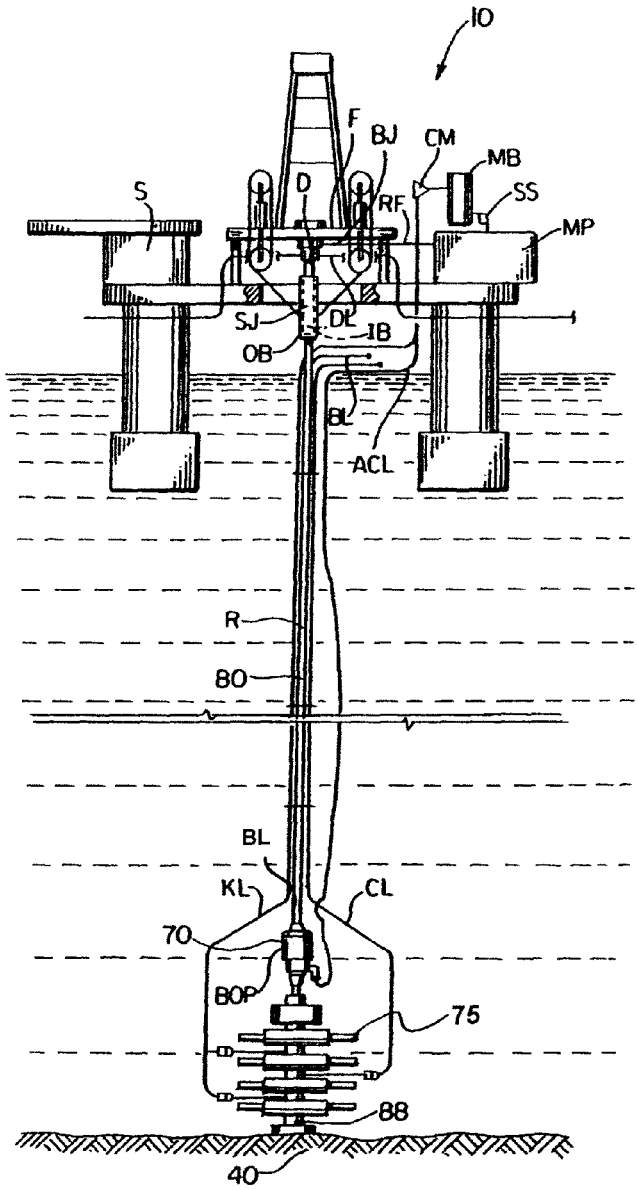
FIG. 1 is a schematic diagram showing a deep water drilling rig with riser and annular blowout preventer.
Figure 2:
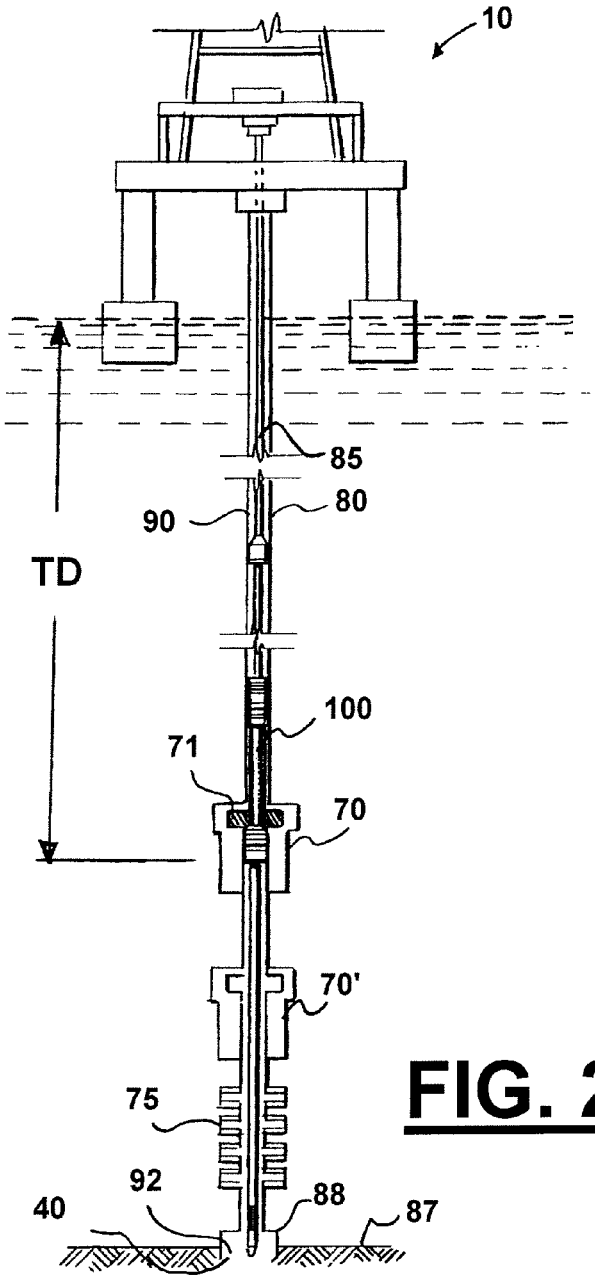
FIG. 2 is another schematic diagram of a deep water drilling rig showing a swivel detachably connected to an annular blowout preventer (a second annular blowout preventer is also shown).

FIGS. 1 and 2 show generally the preferred embodiment of the apparatus of the present invention, designated generally by the numeral 10. Drilling apparatus 10 employs a drilling platform S that can be a floating platform, spar, semi-submersible, or other platform suitable for oil and gas well drilling in a deep water environment. For example, the well drilling apparatus 10 of FIGS. 1 and 2 and related method can be employed in deep water of for example deeper than 5,000 feet (1,500 meters), 6,000 feet (1,800 meters), 7,000 feet (2,100 meters), 10,000 feet (3,000 meters) deep, or deeper.

In FIGS. 1 and 2, an ocean floor or seabed 87 is shown. Wellhead 88 is shown on seabed 11. One or more blowout preventers can be provided including stack 75 and annular blowout preventer 70. The oil and gas well drilling platform S thus can provide a floating structure S having a rig floor F that carries a derrick and other known equipment that is used for drilling oil and gas wells. Floating structure S provides a source of drilling fluid or drilling mud 22 contained in mud pit MP. Equipment that can be used to recirculate and treat the drilling mud can include for example a mud pit MP, shale shaker SS, mud buster or separator MB, and choke manifold CM.

An example of a drilling rig and various drilling components is shown in FIG. 1 of U.S. Pat. No. 6,263,982 (which patent is incorporated herein by reference). In FIGS. 1, 1A, and 2 conventional slip or telescopic joint SJ, comprising an outer barrel OB and an inner barrel IB with a pressure seal therebetween can be used to compensate for the relative vertical movement or heave between the floating rig S and the fixed subsea riser R. A Diverter D can be connected between the top inner barrel IB of the slip joint SJ and the floating structure or rig S to control gas accumulations in the riser R or low pressure formation gas from venting to the rig floor F. A ball joint BJ between the diverter D and the riser R can compensate for other relative movement (horizontal and rotational) or pitch and roll of the floating structure S and the riser R (which is typically fixed).

The diverter D can use a diverter line DL to communicate drilling fluid or mud from the riser R to a choke manifold CM, shale shaker SS or other drilling fluid or drilling mud receiving device. Above the diverter D can be the flowline RF which can be configured to communicate with a mud pit MP. A conventional flexible choke line CL can be configured to communicate with choke manifold CM. The drilling fluid or mud can flow from the choke manifold CM to a mud-gas buster or separator MB and a flare line (not shown). The drilling fluid or mud can then be discharged to a shale shaker SS, and mud pits MP. In addition to a choke line CL and kill line KL, a booster line BL can be used.

FIGS. 1 and 2 are schematic views showing oil and gas well drilling rig 10 connected to riser 80 and having annular blowout preventer 70 (commercially available). FIG. 2 is a schematic view showing rig 10 with swivel 100 separating upper drill or well string 85 and lower drill or well string 86. Swivel 100 is shown detachably connected to annular blowout preventer 70 through annular packing unit seal 71. FIG. 2 is an enlarged view of the drill string or work string 60 that extends between rig 10 and seabed 87 having wellhead 88. In FIG. 2, the drill string or work string 60 is divided into an upper drill or work string 85 and a lower drill or work string 86. Upper string 85 is contained in riser 80 and extends between well drilling rig S and swivel 100. An upper volumetric section 90 is provided within riser 80 and in between drilling rig 10 and swivel 100. A lower volumetric section 92 is provided in between wellhead 88 and swivel 100. The upper and lower volumetric sections 90, 92 are more specifically separated by annular seal unit 71 that forms a seal against sleeve 300 of swivel 100. Annular Blowout Preventer 70 is positioned at the bottom of riser 80 and above stack 75 (which includes a Ram Blowout Preventer). A well bore 40 extends downwardly from wellhead 88 and into seabed 87. Although shown in FIG. 2, in many of the figures the lower completion or drill string 86 (which would be connected to and supported by pin end 150 of mandrel 110) has been omitted for purposes of clarity.

Figure 4:
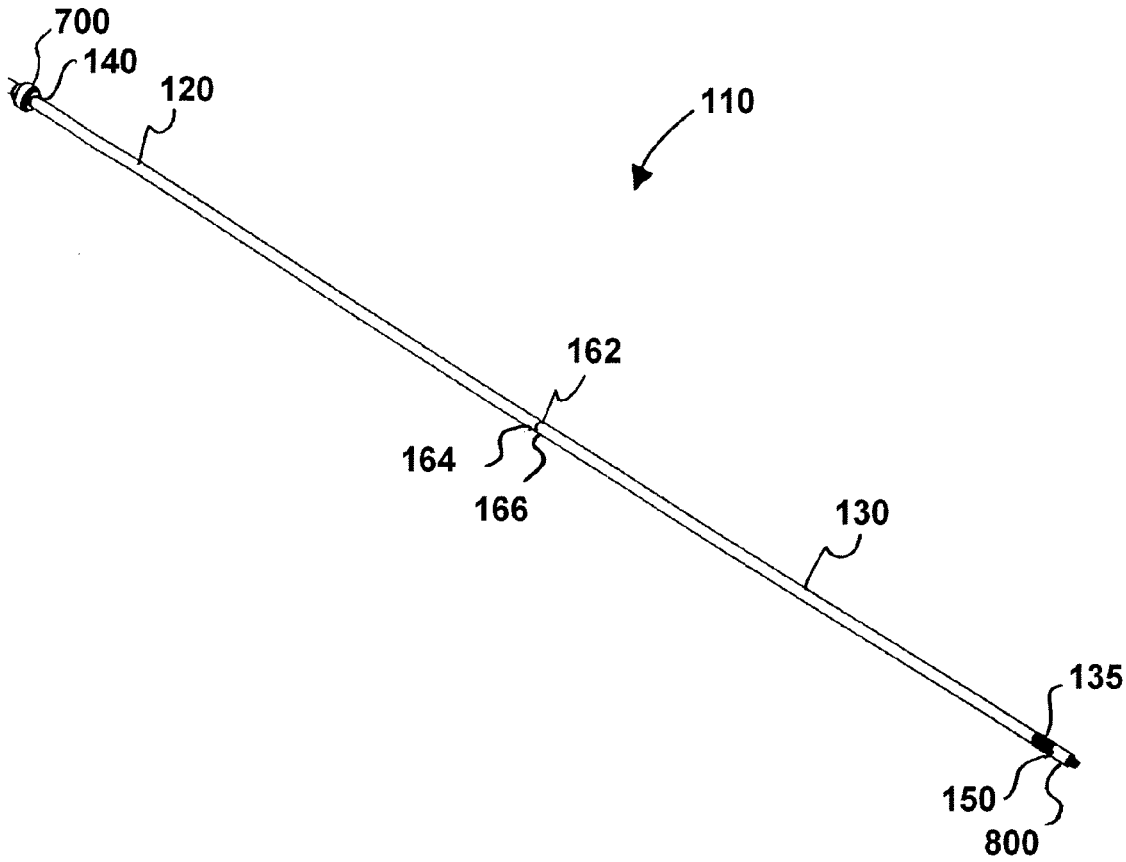
FIG. 4 is a perspective view of a mandrel which can be used in one embodiment.

FIG. 4 shows one embodiment of a mandrel 110 having upper and lower end portions. The upper end portion has joint of pipe 700 and enlarged area 730. The lower end portion of mandrel 110 has fluted area 135 and saver sub 800. Joint of pipe 700 and enlarged area 730 provide frustoconical area 740, protruding section 750, and upper portion 710 of joint of pipe 700.

Figure 3:
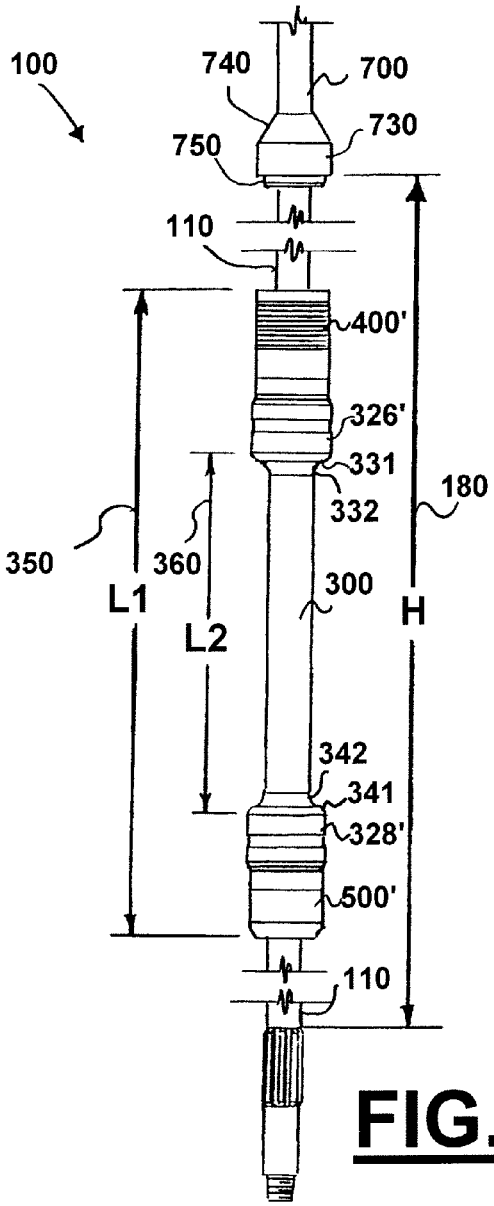
FIG. 3 is a schematic diagram of one embodiment of a reciprocating and/or rotating swivel.
Figure 5:
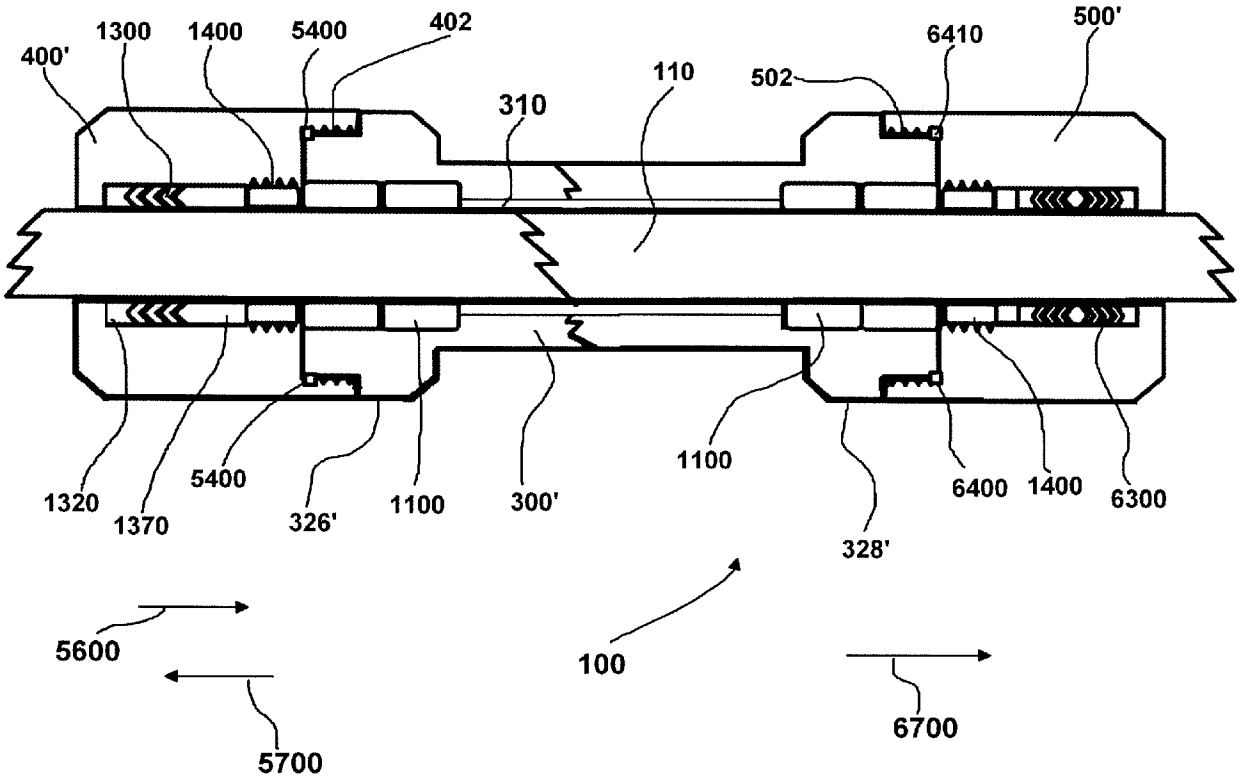
FIG. 5 is a schematic diagram of one embodiment of a rotating and reciprocating tool having threaded end caps for the sleeve which end caps hold the upper and lower packaging units.
Figure 13:
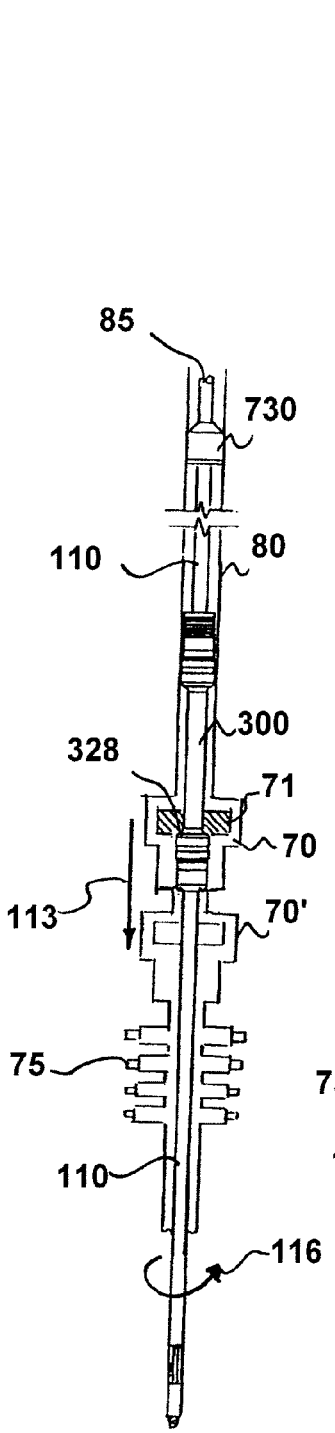
FIGS. 13 through 15 are schematic diagrams illustrating reciprocating motion of a drill or well string through an annular blowout preventer.
Figure 14:
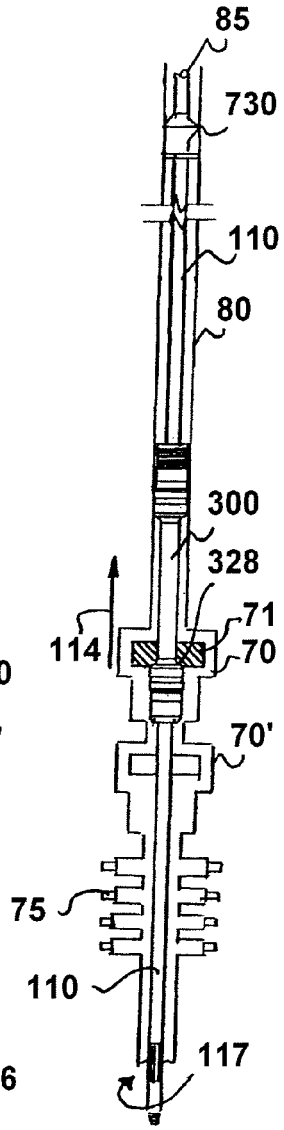
Figure 15:
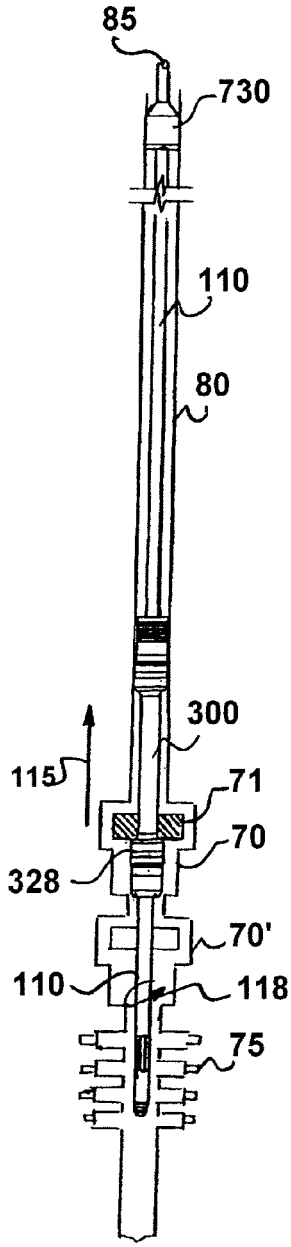

FIGS. 3 and 5 show one embodiment of a swivel 100 which can rotate and/or reciprocate. With such construction drill or well string 85, 86 can be rotated and/or reciprocated while annular blowout preventer 70 is sealed around swivel 100. FIGS. 13 through 15 are schematic diagrams illustrating reciprocating motion of drill or well string 85,86 through annular blowout preventer 70. Swivel 100 includes a sleeve or housing 300. Mandrel 110 is contained within a bore of sleeve 300. Swivel 100 includes an outer sleeve or housing 300 having a generally vertically oriented open-ended bore that is occupied by mandrel 110.

In FIG. 3, sleeve 300 provides upper radiused area 332 that connects with base 331. Sleeve 300 also provides lower radiused area 342 that is connected to lower base 341. Upper catch, shoulder or flange 326 is connected to upper base 331. Similarly, lower catch, shoulder or flange 328' connects to lower base 341. Upper retainer cap 400' is threadably connected to upper catch, shoulder or flange 326' while lower retainer cap 500' is threadably connected to lower catch, shoulder or flange 328' as shown in FIG. 5.

FIGS. 3, and 13 through 15 schematically illustrating reciprocating motion of sleeve or housing 300 relative to mandrel 110. The length 180 of mandrel 110 compared to the overall length 350 of sleeve or housing 300 can be configured to allow sleeve or housing 300 to reciprocate (e.g., slide up and down) relative to mandrel 110. FIGS. 13 through 15 are schematic diagrams illustrating reciprocation and/or rotation between sleeve or housing 300 along mandrel 110 (allowing reciprocation and/or rotation between drill or work string 85,86 at a time when the volume of fluid is desirably to be separated into two volumetric sections by the closing of annular blowout preventer 70.

In FIG. 13, arrow 113 schematically indicates that mandrel 110 is moving downward relative to sleeve or housing 300. Arrows 114 and 115 in FIGS. 14 and 15 respectively schematically indicate upward movement of mandrel 110 relative to sleeve or housing 300. In FIGS. 13 and 15, arrows 116 and 118 respectively schematically indicate counterclockwise rotation between mandrel 110 and sleeve or housing 300. In FIG. 14, arrow 117 schematically indicates clockwise rotation between mandrel 110 and sleeve or housing 300. The change in direction between arrows 113 and 114,115 schematically indicates a reciprocating motion. The change in direction between arrows 116,118 and 117 schematically indicates an alternating type of rotational movement.

Swivel 100 can be made up of mandrel 110 to fit in line of a drill or work string 85,86 and sleeve or housing 300 with a seal and bearing system to allow for the drill or work string 85, 86 to be rotated and reciprocated while swivel 100 where annular seal unit 71 (see FIGS. 13-15) such as when a frac job is performed under the annular blowout preventer. This can be achieved by locating swivel 100 in the annular blow out preventer 70 where annular seal unit 71 can close around sleeve or housing 300 forming a seal between sleeve or housing 300 and annular seal unit 71, and the sealing system between sleeve or housing 300 and mandrel 110 of swivel 100 forming a seal between sleeve or housing 300 and mandrel 110, thus separating the two fluid columns 90, 92 (above and below annular seal unit 71).

The amount of reciprocation (or stroke) can be controlled by the difference between the length of mandrel 110 and the length 350 of the sleeve or housing 300. As shown in FIG. 3, the stroke of swivel 100 can be the difference between height H 180 of mandrel 110 and length L1 350 of sleeve or housing 300. In one embodiment height H 180 can be about eighty feet (24.38 meters) and length L1 350 can be about eleven feet (3.35 meters). In other embodiments the length L1 350 can be about 1 foot (30.48 centimeters), about 2 feet (60.98 centimeters), about 3 feet (91.44 centimeters), about 4 feet (122.92 centimeters), about 5 feet (152.4 centimeters), about 6 feet (183.88 centimeters), about 7 feet (213.36 centimeters), about 8 feet (243.84 centimeters), about 9 feet (274.32 centimeters), about 10 feet (304.8 centimeters), about 12 feet (365.76 centimeters), about 13 feet (396.24 centimeters), about 14 feet (426.72 centimeters), about 15 feet (457.2 centimeters), about 16 feet (487.68 centimeters), about 17 feet (518.16 centimeters), about 18 feet (548.64 centimeters), about 19 feet (579.12 centimeters), and about 20 feet (609.6 centimeters) (or about midway spaced between any of the specified lengths). In various embodiments, the length of the swivel's sleeve or housing 300 compared to the length H180 of its mandrel 110 is between two and thirty times. Alternatively, between two and twenty times, between two and fifteen times, two and ten times, two and eight times, two and six times, two and five times, two and four times, two and three times, and two and two and one half times. Also alternatively, between 1.5 and thirty times, 1.5 and twenty times, 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

In various embodiments, at least partly during the time annular blowout preventer 70 is closed on sleeve 300 during a frac job, the drill or well string 85,86 is reciprocated longitudinally the distance of at least about ½ inch (1.27 centimeters), about 1 inch (2.54 centimeters), about 2 inches (5.04 centimeters), about 3 inches (7.62 centimeters), about 4 inches (10.16 centimeters), about 5 inches (12.7 centimeters), about 6 inches 15.24 centimeters), about 1 foot (30.48 centimeters), about 2 feet (60.96 centimeters), about 3 feet (91.44 centimeters), about 4 feet (1.22 meters), about 6 feet (1.83 meters), about 10 feet (3.048 meters), about 15 feet (4.57 meters), about 20 feet (6.096 meters), about 25 feet (7.62 meters), about 30 feet (9.14 meters), about 35 feet (10.67 meters), about 40 feet (12.19 meters), about 45 feet (13.72 meters), about 50 feet (15.24 meters), about 55 feet (16.76 meters), about 60 feet (18.29 meters), about 65 feet (19.81 meters), about 70 feet (21.34 meters), about 75 feet (22.86 meters), about 80 feet (24.38 meters), about 85 feet (25.91 meters), about 90 feet (27.43 meters), about 95 feet (28.96 meters), about 100 feet (30.48 meters), and/or between the range of each or a combination of each of the above specified distances.

Swivel 100 can be comprised of mandrel 110 and sleeve or housing 300. Sleeve or housing 300 can be rotatably, reciprocably, and/or sealably connected to mandrel 110. Accordingly, when mandrel 110 is rotated and/or reciprocated sleeve or housing 300 can remain stationary to an observer insofar as rotation and/or reciprocation is concerned. Sleeve or housing 300 can fit over mandrel 110 and can be rotatably, reciprocably, and sealably connected to mandrel 110.

In FIG. 3, sleeve or housing 300 can be rotatably connected to mandrel 110 by one or more bushings and/or bearings 1100, preferably located on opposed longitudinal ends of sleeve or housing 300. In FIG. 3, sleeve or housing 300 can be sealingly connected to mandrel 110 by a one or more seals, preferably located on opposed longitudinal ends of sleeve or housing 300. The seals can seal the gap 315 between the interior 310 of sleeve or housing 300 and the exterior of mandrel 110. In FIG. 3, sleeve or housing 300 can be reciprocally connected to mandrel 110 through the geometry of mandrel 110 which can allow sleeve or housing 300 to slide relative to mandrel 110 in a longitudinal direction (such as by having a longitudinally extending distance H 180 of the exterior surface of mandrel 110 a substantially constant diameter). In FIG. 3, bushings and/or bearings 1100 can include annular bearings, tapered bearings, ball bearings, teflon bearing sleeves, and/or bronze bearing sleeves, allowing for low friction levels during rotating and/or reciprocating procedures.

The various components of swivel 100 will be individually described below.

Mandrel

FIG. 4 is a perspective view of mandrel 110 which can comprise upper end 120 and lower end 130. Mandrel 110 preferably is designed to take substantially all of the structural load from upper well string 85 and lower well string 86 (at least the load of lower well string 86). Mandrel 110 lower end 130 can include a pin connection 150 or any other conventional connection. Upper end 120 can include box connection 140 or any other conventional connection. Central longitudinal passage 160 can extend from upper end 120 through lower end 130. As shown in FIGS. 2, 3, and 13-15, mandrel 110 can in effect become a part of upper and lower well string 85,86. Because of a long desired length for mandrel 110, it can include two sections—upper end or section 120 and lower end or section 130 which are connected at connection point 162. At connection point 162 upper end 120 can include a pin connection 164 and lower end can include a box connection 166 (although other conventional type connections can be used). To assist in sealing central longitudinal passage 160, at connection 162 one, two, or more seals can be used (such as polypack seals 168, 170 or other seals).

In one embodiment upsets, such as joints of pipe can be placed respectively on upper and lower sections 120, 130 of mandrel 110 which act as stops for longitudinal movement of sleeve 300. Upset or joints of pipe can include larger diameter sections than the outer diameter of mandrel. Having larger diameters can prevent sleeve 300 from sliding off of mandrel 110. Joints of pipe can act as saver subs for the ends of mandrel 110 which take wear and handling away from mandrel 110. Joints of pipe are preferably of shorter length than a regular 20 or 40 foot joint of pipe, however, can be of the same lengths. In one embodiment joints of pipe include saver portions which engage sleeve or housing 300 at the end of mandrel 110. Saver portions can be shaped to cooperate with the ends of sleeve or housing 300. Saver portions can be of the same or a different material than sleeve or housing 300, such as polymers, teflon, rubber, or other material which is softer than steel or iron. In one embodiment a portion or portions of mandrel 110 itself can be enlarged to act as a stop(s) for movement of sleeve 300.

Figure 16:
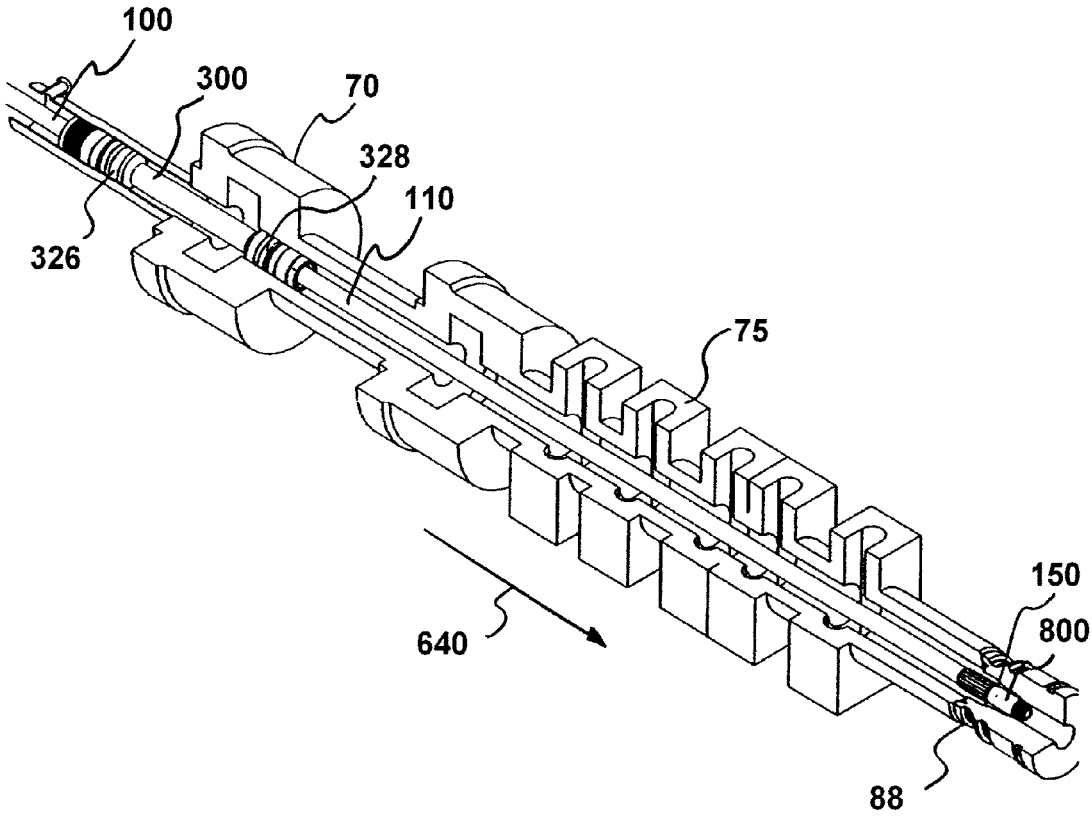
FIG. 16 is a sectional perspective view showing the swivel of FIG. 5 inside the annular blowout preventer with the lower catch in contact with the annular of the annular blow out preventer (the annular being omitted to clarity).
Figure 17:
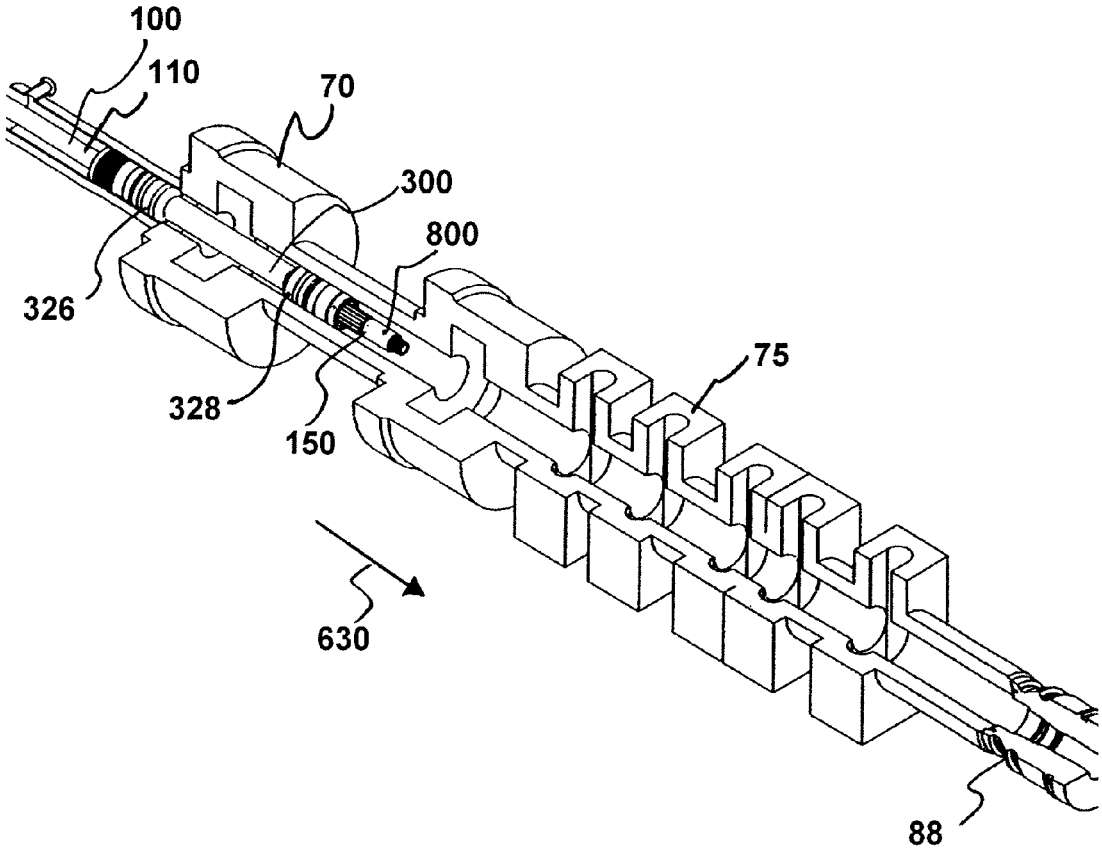
FIG. 17 is a sectional perspective view showing the swivel of FIG. 5 inside the annular blowout preventer with the upper catch in contact with the annular of the annular blow out preventer (the annular being omitted to clarity) and with the mandrel reciprocated upwardly.
Figure 18:
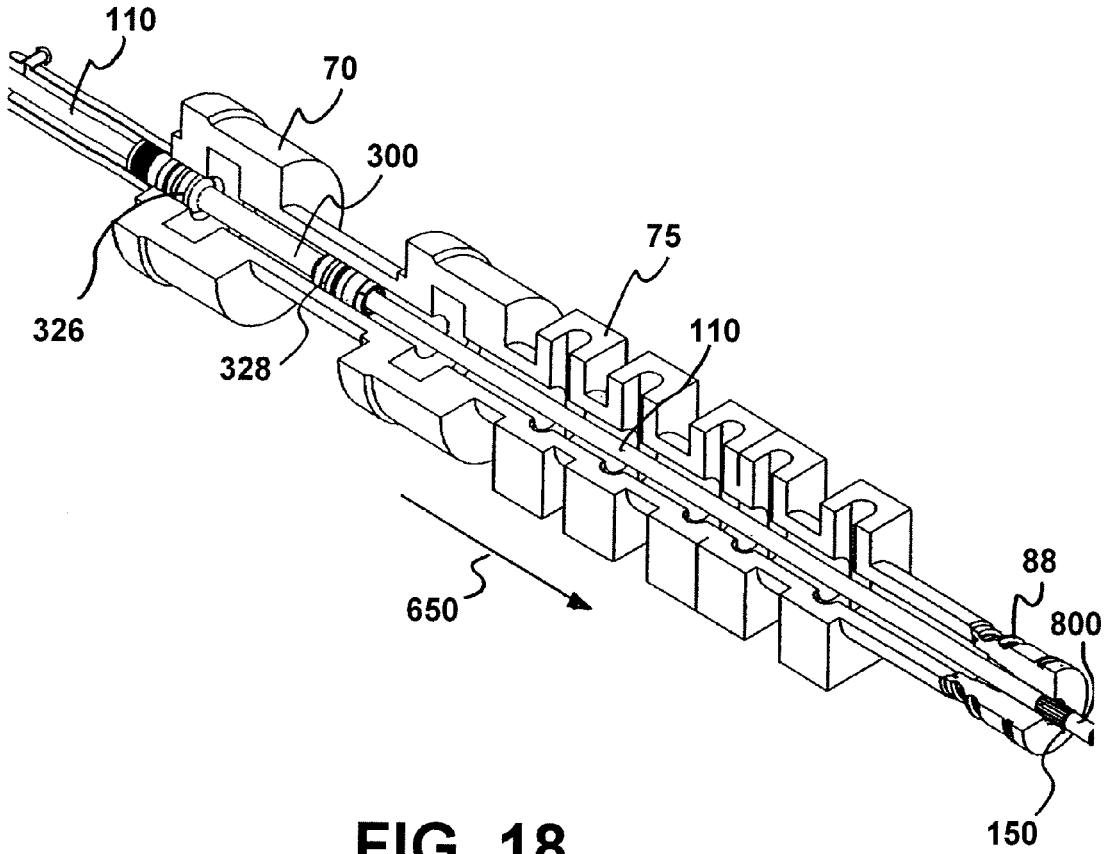
FIG. 18 is a sectional perspective view showing the swivel of FIG. 5 inside the annular blowout preventer with the upper catch in contact with the annular of the annular blow out preventer (the annular being omitted to clarity) and with the mandrel reciprocated downwardly.
Figure 19:
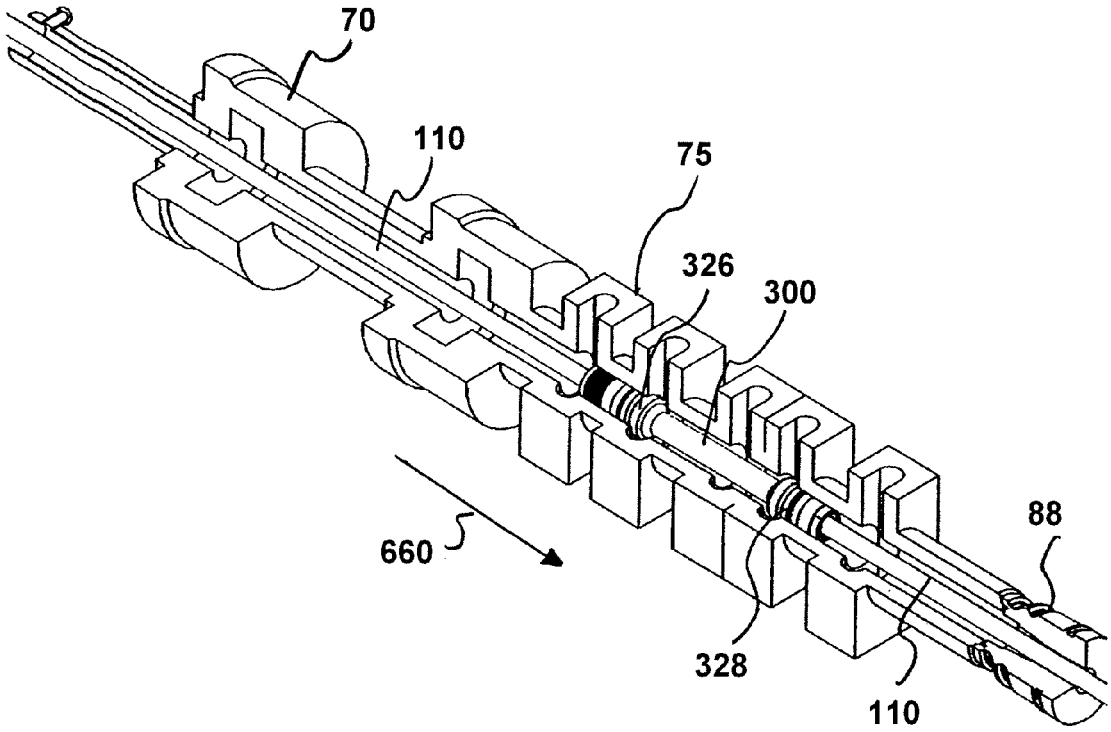
FIG. 19 is a sectional perspective view showing the swivel of FIG. 5 inside the annular blowout preventer with the upper catch in contact with the annular of the annular blow out preventer (the annular being omitted to clarity) and with the mandrel reciprocated upwardly.
Figure 20:
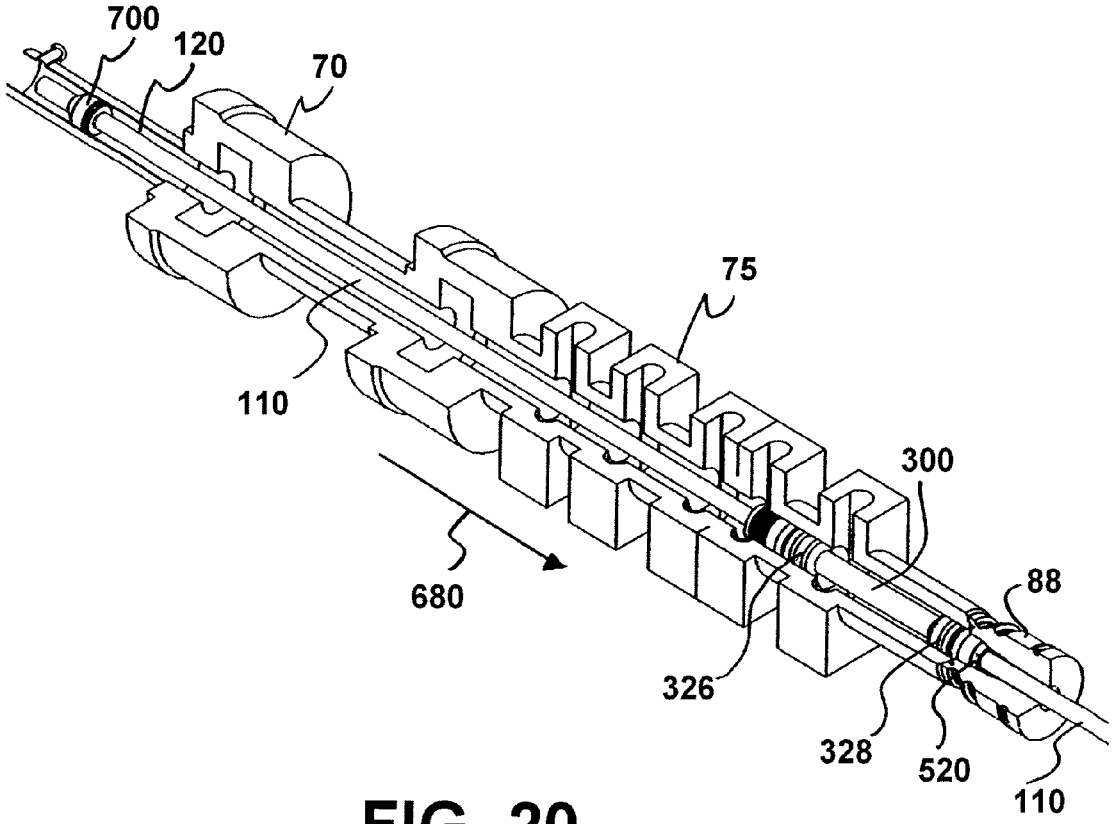
FIG. 20 is a sectional perspective view showing the swivel of FIG. 5 after leaving the annular blowout preventer (the annular being omitted to clarity).

As shown in FIGS. 13 and 15, joint of pipe 700 can be connected to upper portion 120 of mandrel 110. Joint 700 can comprise upper portion 710, lower portion 720, enlarged area 730, frustoconical area 740, and protruding section 750. Joint 700 can limit the upper range of reciprocal motion between sleeve or housing 300 and mandrel 110. As shown in FIGS. 13 and 15, lower portion 130 of mandrel can include As shown in FIG. 4, lower portion 130 of mandrel 110 can include enlarged fluted area 135. Fluted area 135 can be used to limit the maximum downward movement by sleeve or housing 300 relative to mandrel 110. This area can be fluted to assist in fluid flow between the external diameter of fluted area and the internal diameter of a passageway through which fluted area is passing (for example, the internal diameter of well head 88). Where these two diameters are relatively close to each other, the flutes can assist in fluid flow between the two diameters. FIG. 16 also shows a saver sub 800 connected to the pin end 150 of mandrel 110, which can protect or save the threaded area of pin end 150.

To reduce friction between mandrel 110 and sleeve 300 during rotational and/or reciprocational type movement, mandrel 110 can include a hard chromed area on its outer diameter throughout the travel length (or stroke) of sleeve 300 which can assist in maintaining a seal between mandrel 110 and sleeve or housing 300's sealing area during rotation and/or reciprocation activities or procedures. Alternatively, the outer diameter throughout the travel length (or stroke) of sleeve or housing 300 can be treated, coated, and/or sprayed welded with a materials of various compositions, such as hard chrome, nickel/chrome or nickel/aluminum (95 percent nickel and 5 percent aluminum). A material which can be used for coating by spray welding is the chrome alloy TAFA 95MX Ultrahard Wire (Armacor M) manufactured by TAFA Technologies, Inc., 146 Pembroke Road, Concord N.H. TAFA 95 MX is an alloy of the following composition: Chromium 30 percent; Boron 6 percent; Manganese 3 percent; Silicon 3 percent; and Iron balance. The TAFA 95 MX can be combined with a chrome steel. Another material which can be used for coating by spray welding is TAFA BONDARC WIRE-75B manufactured by TAFA Technologies, Inc. TAFA BONDARC WIRE-75B is an alloy containing the following elements: Nickel 94 percent; Aluminum 4.6 percent; Titanium 0.6 percent; Iron 0.4 percent; Manganese 0.3 percent; Cobalt 0.2 percent; Molybdenum 0.1 percent; Copper 0.1 percent; and Chromium 0.1 percent. Another material which can be used for coating by spray welding is the nickel chrome alloy TAFALOY NICKEL-CHROME-MOLY WIRE-71T manufactured by TAFA Technologies, Inc. TAFALOY NICKEL-CHROME-MOLY WIRE-71T is an alloy containing the following elements: Nickel 61.2 percent; Chromium 22 percent; Iron 3 percent; Molybdenum 9 percent; Tantalum 3 percent; and Cobalt 1 percent. Various combinations of the above alloys can also be used for the coating/spray welding. The exterior of mandrel 110 can also be coated by a plating method, such as electroplating or chrome plating. Its surface and its surface can be ground/polished/finished to a desired finish to reduce friction packing assemblies.

Mandrel 110 can be machined from a 4340 heat treated steel bar stock or heat treated forgings (alternatively, can be from a rolled forging). Preferably, ultra sound inspections are performed using ASTM A388. Preferably, internal and external surfaces are wet magnetic particle inspected using ASTM 709 (No Prods/No Yokes). The preferred overall length of mandrel 110 is about 77 feet (23.5 meters). The preferred length of upper end 120 is 38.64 feet (11.78 meters) and lower end 130 is about 38.5 feet (11.73 meters). Preferably pin end 150 and box end 140 can be joined through a modified 5½ inch (14 centimeter) FH connection. Preferably, design of these connections is based on a 7½ inch (19 centimeter) outer diameter, 3½ inch (8.9 centimeter) inner diameter and a material yield strength of 135,000 psi (931,000 kilopascals). Mandrel 110 is preferably designed to handle the tensile and torsional loads that a completion string supports (such as from annular blowout preventer 70 to the bottom of well bore 40) and meet the requirements of API Specifications 7 and 7G.

The following properties are preferred:

| | |
|---|---|
| minimum tensile yield strength | 135,000 psi (931,000 kilopascals) (Tensile tested per ASTM A370, 2% offset method). |
| minimum elongation percent | 13% |
| Brinell hardness range | 341/388 BHN |
| impact strength | average impact value not less than 27 foot-pounds with no single value below 12 foot-pounds when tested at −4 degrees F. (−20 degrees C.) as per ASTM E23. |

Mandrel's 100 box 140 and pin 150 rotary shouldered connections preferably conform to dimensions provided in tables 25 and 26 of API specification 7.

At connection 162, there is preferably included connecting portions with 7 inch outer diameter s and 3½ inch (8.9 centimeters) inner diameters having a material yield strength of 135,000 psi (931,000 kilopascals). The two connecting portions 120, 130 are preferably center piloted to insure that their outer diameters remain concentric after makeup. Preferably, the box and pin bevel diameter is eliminated at connection 162 and dual high pressure seals are used to seal from fluids migration both internally and externally. Preferably, fluid tongs are used to make up connection 162 to prevent scarring or damage to the exterior surface of mandrel 110. In an alternative embodiment o-rings with one or two backup rings on either side can be used. Strength and Design Formulas of API 7G-APPENDIX A provide the following load carrying specifications for mandrel 110.

| End Connections | |
|---|---|
| Torque To Yield Rotary Shoulder connection | 90,400 foot-pounds (122.5 kN-M); |
| Recommended makeup torque at 60% of Yield Stress | 54,250 foot-pounds (73.6 kN-M); |
| Tensile Load to Yield at 0 psi internal pressure | 2,011,500 pounds (9,140 kilo newtons); |
| **Center Connection** | |
| Torque To Yield Rotary Shoulder connection | 70,800 foot-pounds (96 kN-M); |
| Recommended makeup torque at 60% of Yield Stress | 42,500 foot-pounds (57.6 kN-M); |
| Tensile Load to Yield at 0 psi internal pressure | 2,011,500 pounds (9,140 kilo newtons); |

*These center connection ratings also apply to connections between the upper end and the box end limit sub. The maximum make up torque for wet tongs is believed to be 34,000 foot-pounds.

| | |
|---|---|
| Mandrel burst pressure | 55,500 psi (383,000 kilopascals) |
| Mandrel collapse pressure | 40,500 psi (279,000 kilopascals) |

Sleeve or Housing

FIG. 5 is a schematic view of sleeve or housing 300 which can include upper end 302, lower end 304, and interior section 310. In one embodiment sleeve or housing 300 can slide and/or reciprocate relative to mandrel 110. At least a portion of the surface of sleeve or housing 300 can be designed to increase its frictional coefficient, such as by knurling, etching, rings, ribbing, etc. This can increase the gripping power of annular seal 71 (of blow-out preventer 70) against sleeve or housing 300 where there exists high differential pressures above and below blow-out preventer 70 which differential pressures tend to push sleeve or housing 300 in a longitudinal direction.

Sleeve or housing can include upper and lower catches, shoulders, flanges 326',328' (or upsets) on sleeve or housing 300. Upper and lower catches, shoulders, flanges 326',326' restrict relative longitudinal movement of sleeve or housing 300 with respect to annular blow out preventer 70 where high differential pressures exist above and or below annular blow-out preventer 70 which differential pressures tend to push sleeve or housing 300 in a longitudinal direction.

When displacing, housing or sleeve 300 is preferably located in annular blowout preventer 70 with annular seal 71 closed on sleeve or housing 300 between upper and lower catches, shoulders, flanges 326', 328'. As displacement is performed differential pressures tend to push up or down on sleeve or housing 300 causing one of the catches, flanges, shoulders to be pushed against annular blowout preventer 70 seal 71. It is believed that this differential pressure acts on the cross sectional area of sleeve or housing 300 (ignoring the catch, shoulder, sleeve) and the mandrel's 110 seven inch diameter. One example of a differential force is 125,000 pounds (556 kilo newtons) of thrust which sleeve or housing 300 transfers to annular blowout preventer 70. These forces should be taken into account when designing catches, shoulders, flanges to transfer such forces to blowout preventer 70, such as through annular seal 71 or back support for this annular seal.

Upper and lower catches, shoulders, flanges 326', 328' can be integral with or attachable to sleeve or housing 300. In one embodiment one or both catches, shoulders, flanges 326', 328' are integral with and machined from the same piece of stock as sleeve or housing 300. In one embodiment one or both catches, shoulders, flanges 326', 328' can be threadably connected to sleeve or housing 300. In one embodiment one or both catches, shoulders, flanges 326', 328' can be welded or otherwise connected to sleeve or housing 300. In one embodiment one or both catches, shoulders, flanges 326', 328' can be heat or shrink fitted onto sleeve or housing 300. In one embodiment upper and lower catches, shoulders, flanges 326', 328' are of similar construction. In one embodiment upper and lower catches, shoulders, flanges 326', 328' have shapes which are curved or rounded to resist cutting/tearing of annular seal unit 71 if by chance annular seal unit 71 closes on either upper or lower catch, shoulder, flange 326', 328'. In one embodiment upper and lower catches 326', 328' have are constructed to avoid any sharp corners to minimize any stress enhances (e.g., such as that caused by sharp corners) and also resist cutting/tearing of other items.

In one embodiment the largest radial distance (i.e., perpendicular to the longitudinal direction) from end to end for either catch, shoulder, flange 326', 328' is less than the size of the opening in the housing for blow-out preventer 70 so that sleeve or housing 300 can pass completely through blow-out preventer 70. In one embodiment the upper surface of upper catch, shoulder, flange 326' and/or the lower surface of lower catch, shoulder, flange 328' have frustoconical shapes or portions which can act as centering devices for sleeve or housing 300 if for some reason sleeve or housing 300 is not centered longitudinally when passing through blow-out preventer 70 or other items in riser 80 or well head 88. In one embodiment upper catch, shoulder, flange 326' is actually larger than the size of the opening in the housing for blow-out preventer 70 which will allow sleeve or housing to make metal to metal contact with the housing for blow-out preventer 70.

In one embodiment the largest distance from either catch, shoulder, flange 326',328' is less than the size of the opening in the housing for blow-out preventer 70, but large enough to contact the supporting structure for annular seal unit 71 thereby allowing metal to metal contact either between upper catch, shoulder, flange 326' and the upper portion of supporting structure for seal unit 71 or allowing metal to metal contact between lower catch, shoulder, flange 328 and the lower portion of supporting structure for seal unit 71. This allows either catch, shoulder, flange to limit the extent of longitudinal movement of sleeve or housing 300 without relying on frictional resistance between sleeve or housing 300 and annular seal unit 71. Preferably, contact is made with the supporting structure of annular seal unit 71 to avoid tearing/damaging seal unit 71 itself.

Upper catch, shoulder, flange 326' can include base 331, radiused area 332, and upper end 302. Upper end 302 can be shaped to fit with upper retainer cap 400' which is threadably connected thereto.

Radiused area 332 can be included to reduce or minimize stress enhancers between catch, shoulder, flange 326 and sleeve or housing 300. Other methods of stress reduction can be used. Alternatively radiused area 332 and base 331 can be shaped to coordinate with annular seal member 71 of annular blow-out preventer 70, such as where there will be no metal to metal contact between catch, shoulder, flange 326 and blow-out preventer 70 (e.g., where catch, shoulder, flange 326' only contacts annular seal member 71 and does not contact any of the supporting framework for annular seal member 71). Lower catch, shoulder, flange 328' can be similar to, symmetric with, or identical to upper catch, shoulder, or flange 326'.

In an alternative embodiment lower and/or upper catches, shoulders, flanges 328', 326' can be shaped to act as centering devices for swivel 100 if for some reason swivel 100 is not centered longitudinally when passing through blow-out preventer 70.

Threadable end caps can be provided for sleeve or housing 300. Upper end 302 of sleeve or housing 300 can be threadably connected to upper retainer cap 400'.

Lower end 304 of sleeve or housing 300 can be threadably connected to lower retainer cap 500'. Lower retainer cap 500' can serve as a bearing surface where sleeve or housing 300 moves all the way to the lower end of lower portion 120 of mandrel.

Sleeve or housing 300 can be machined from a 4340 heat treated steel bar stock or heat treated forgings (alternatively, can be from a rolled forging). Preferably, ultra sound inspections are performed using ASTM A388. Preferably, internal and external surfaces are wet magnetic particle inspected using ASTM 709 (No Prods/No Yokes). The following properties are preferred:

| | |
|---|---|
| minimum tensile yield strength | 135,000 psi (931,000 kilopascals) (Tensile tested per ASTM A370, 2% offset method). |
| minimum elongation percent | 15% |
| Brinell hardness range | 293/327 BHN |
| impact strength | average impact value not less than 31 foot-pounds (42 N-M) with no single value below 24 foot-pounds (32.5 N-M) when tested at 4 degrees F. (15.6 degrees C.) as per ASTM E23. |
| minimum preferred factor of safety (based on yield strength and pressure at lower choke line valve) | 5.26:1 |
| sleeve or housing burst pressure | 28,500 psi (197,000 kilopascals) |
| sleeve or housing collapse pressure | 23,500 psi (162,000 kilopascals) |

Preferably, on opposed longitudinal ends of sleeve or housing 300 thrust bearings are provide. These thrust bearings can serve as a safety feature where an operator attempts to overstroke the mandrel 100 relative to the sleeve or housing 300 causing engagement between these two items and creation of a thrust load. The thrust bearing rating is preferably as follows:

| | |
|---|---|
| | Box End |
| continuous rating @60 RPM (3000 hours) | 200,000 pounds (890 kilo newtons) |
| intermittent rating @60 RPM (300 hours) | 400,000 pounds (1,780 kilo newtons) |
| structural rating @0 RPM | 1,600,000 pounds (7,100 kilo newtons) |
| | Pin End |
| continuous rating @60 RPM (3000 hours) | 135,000 pounds (600 kilo newtons) |
| intermittent rating @60 RPM (300 hours) | 270,000 pounds (1,200 kilo newtons) |
| structural rating @0 RPM | 1,100,000 pounds (4,900 kilo newtons) |

Bearing and Packing Assembly

FIG. 5 is a schematic diagram showing one embodiment for bearing and packing assembly 1000. Bearing and packing assembly can include bearing 1100, packing stack 6300, and packing retainer nut 1400. Lower retainer cap 500' can be threadably connected to sleeve 300 though threads 502, and can be used to keep bearing 1100 in sleeve or housing 300. Upper retainer cap 400' can be threadably connected to sleeve 300 though threads 402, and can be used to keep bearing 1100 in sleeve or housing 300.

Figure 6:
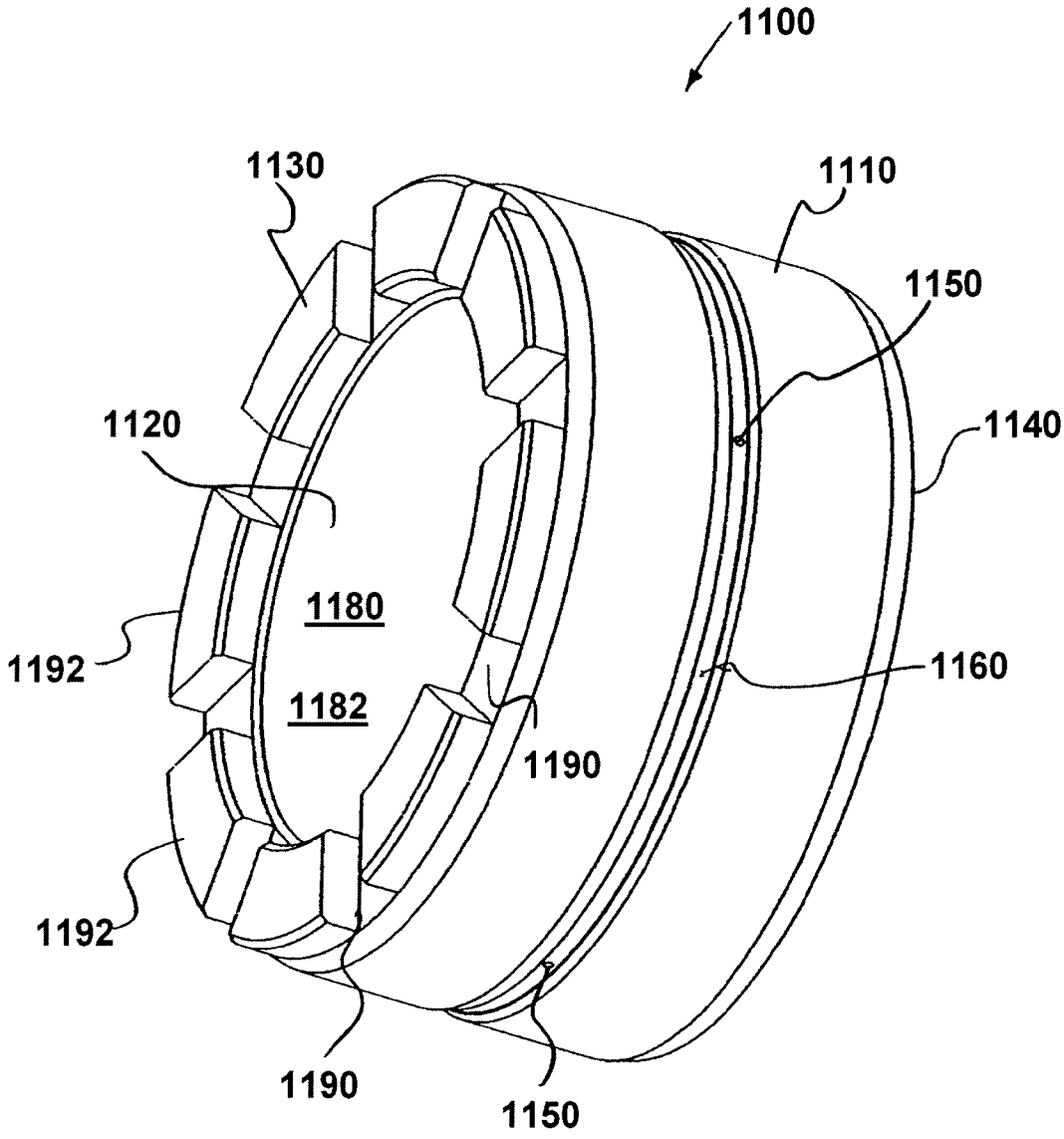
FIG. 6 is a perspective view of a bearing or bushing shown in FIG. 5.

FIG. 6 is a perspective view of a bearing or busing 1100. Bushing 1100 can be of metal or composite construction—either coated with a friction reducing material and/or comprising a plurality of lubrication enhancing inserts 1182 (not shown). Alternatively, bearing or bushing 1100 can rely on lubrication provided by different metals moving relative to one another. Bushings with lubrication enhancing inserts can be conventionally obtained from Lubron Bearings Systems located in Huntington Beach, Calif. Bushing 1100 is preferably comprised of ASTM B271-C95500 centrifugal cast nickel aluminum bronze base stock with solid lubricant impregnated in the sliding surfaces. Lubrication enhancing inserts preferably comprise PTFE teflon epoxy composite dry blend lubricant (Lubron model number LUBRON AQ30 yield pressure 15,000 psi) and/or teflon and/or nylon. Different inserts can be of similar and/or different construction. Alternatively, lubrication enhancing inserts can be AQ30 PTFE non-deteriorating graphite free solid lubricant suitable for long term submersion in seawater. Preferably, lubrication inserts take up more than 30 percent of the bearing surface areas seeing relative movement. For example one surface of bearing or bushing 1100 can have inserts of one construction/composition while a second surface of can have inserts of a different construction/composition. Additionally, inserts on one surface can be of varying construction/composition. Circular inserts are preferred however, other shaped inserts can be used. Bearing or bushing 1100 can comprise outer surface 1110, inner surface 1120, upper surface 1130, and lower surface 1140. Inserts 1182 can be limited to the surfaces of bearing or bushing 1100 which see movement during relative rotation and/or longitudinal movement between mandrel 110 and sleeve or housing 300 (with swivel 100 this would be the inner surface 1120 of bearing or bushing 1100).

Preferably, bearing or bushing 1100 is a heavy duty sleeve type bearing which is self lubricated and oil bathed. Preferably, it is designed to handle high radial loads and allow mandrel 110 to rotate and reciprocate.

As shown in FIGS. 5 and 6, bearing or bushing 1100 can be supported between end caps 400' or 500' and sleeve 300. Assisting in lubricating surfaces which move relative to busing or bearing 1100, one or more radial openings 1150 can be radially spaced apart around each bushing or bearing 1100 through a perimeter pathway 1160. Through openings 1150 a lubricant can be injected which can travel to inner surface 1120 along with lower surface 1140 providing a lubricant bath. The lubricant can be grease, oil, teflon, graphite, or other lubricant. The lubricant can be injected through a lubrication port (e.g., upper lubrication port 311 or lower lubrication port 312). Perimeter pathway 1160 can assist in circumferentially distributing the injected lubricant around bearing or bushing 1100, and enable the lubricant to pass through the various openings 1150. Preferably no sharp surfaces/corners exist on outer surface 1110 of bearing or bushing 1100 which can damage seals and/or o-rings when (during assembly and disassembly of swivel 100) bearing or bushing 1100 passes by the seals and/or o-rings. Alternatively, outer surface 1110 can be constructed such that it does not touch any seals and/or o-rings when being inserted into sleeve or housing 300.

Figure 7:
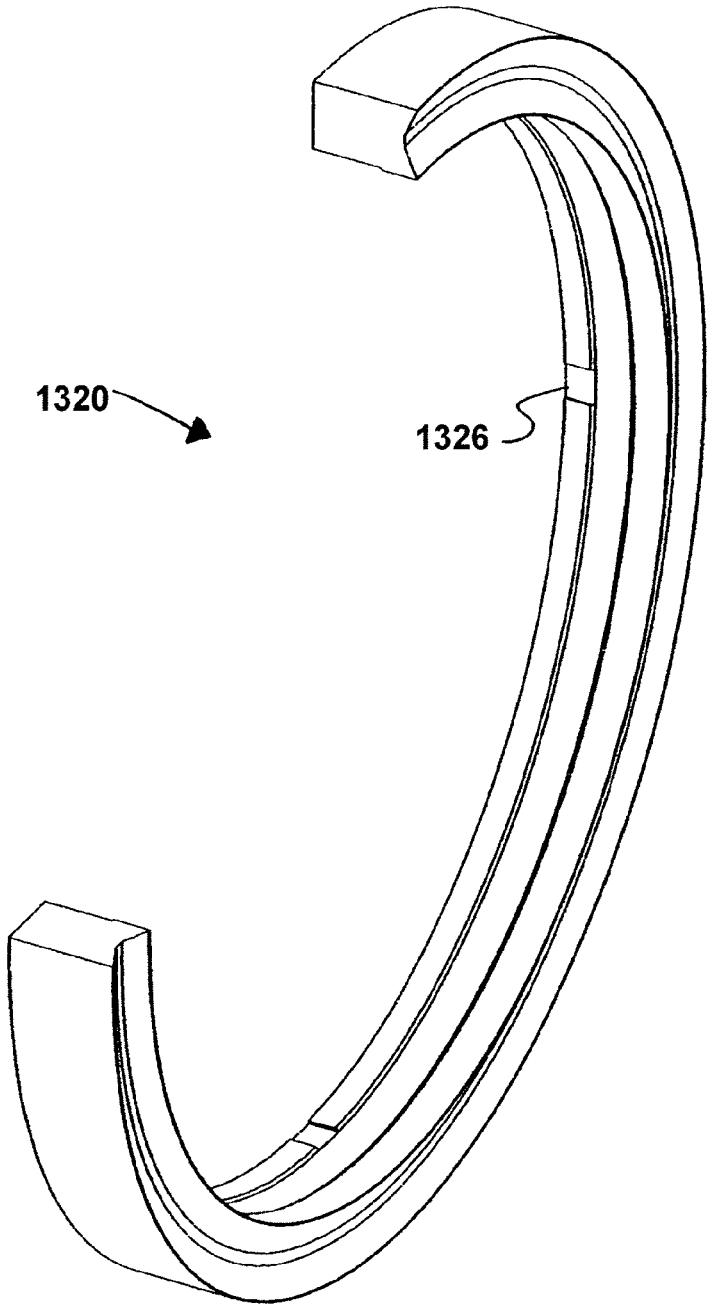
FIG. 7 is a perspective view of a female spacer for the bearing and packing assembly shown in FIG. 5.

FIG. 7 is a perspective view of female backup ring (or packing ring) 1320 which can include plurality of grooves for transmission of lubricant to plurality of seals 1322. Preferably, backup ring 1320 is composed of a bearing grade peek material (such as material number 781 supplied by CDI Seals out of Humble, Tex.).

Figure 8:
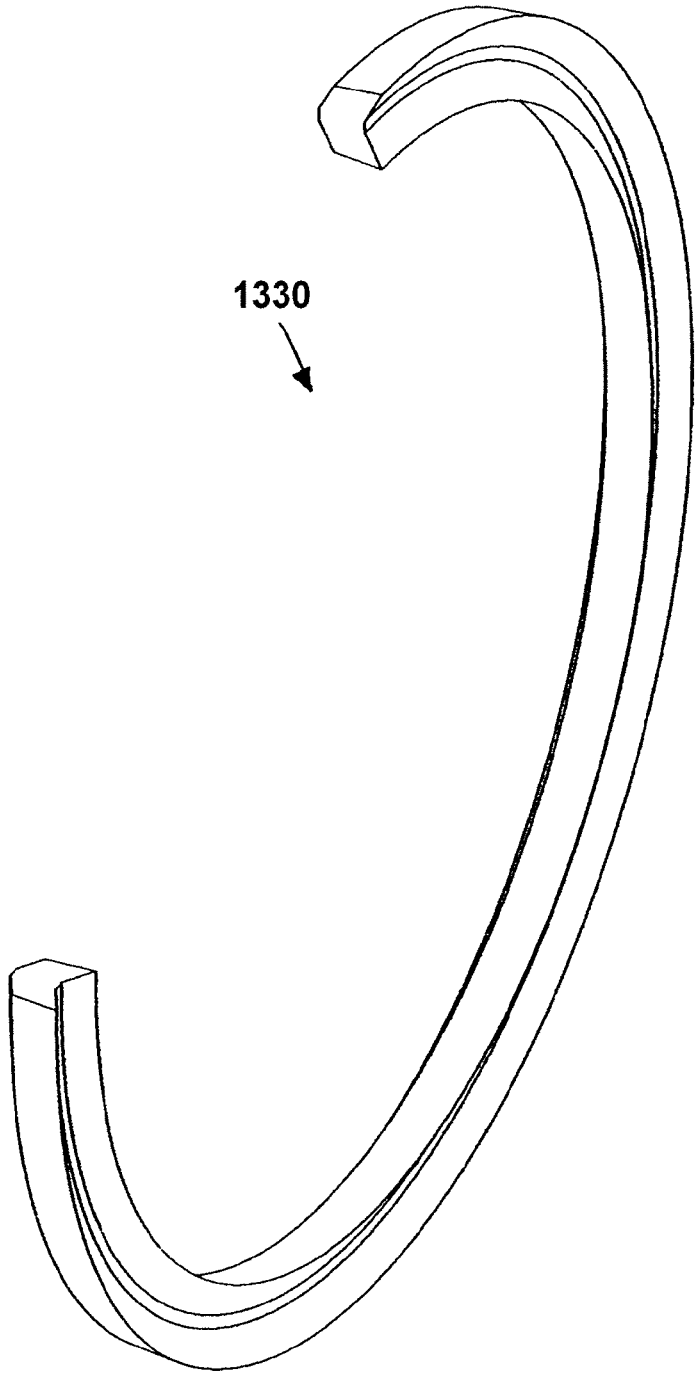
FIG. 8 is a perspective view of a packing ring for the bearing and packing assembly shown in FIG. 5.

FIG. 8 is a perspective view of an exemplar packing ring or seal (e.g., 5340, 5350, 6340, 6360, 6370, 6380) for the plurality of seals.

Figure 9:
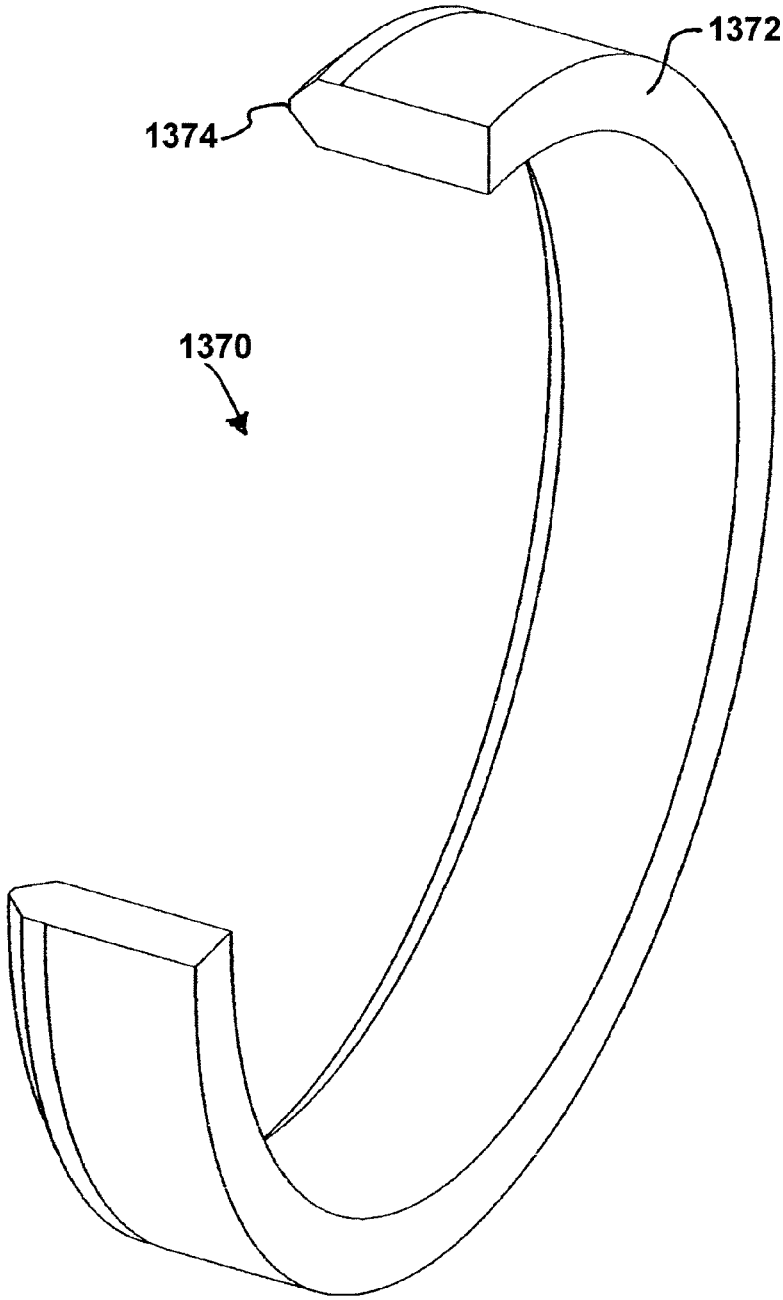
FIG. 9 is a perspective view of a male packing ring for the bearing and packing assembly shown in FIG. 5.

FIG. 9 is a perspective view of a male packing ring 1370 which can comprise first end 1372 and second end 1374 and is preferably machined from SAE 660 BRONZE or SAE 954 Aluminum Bronze with a flat head and 45 degrees from the vertical, which can be used as packaging ring 5370.

Figure 10:
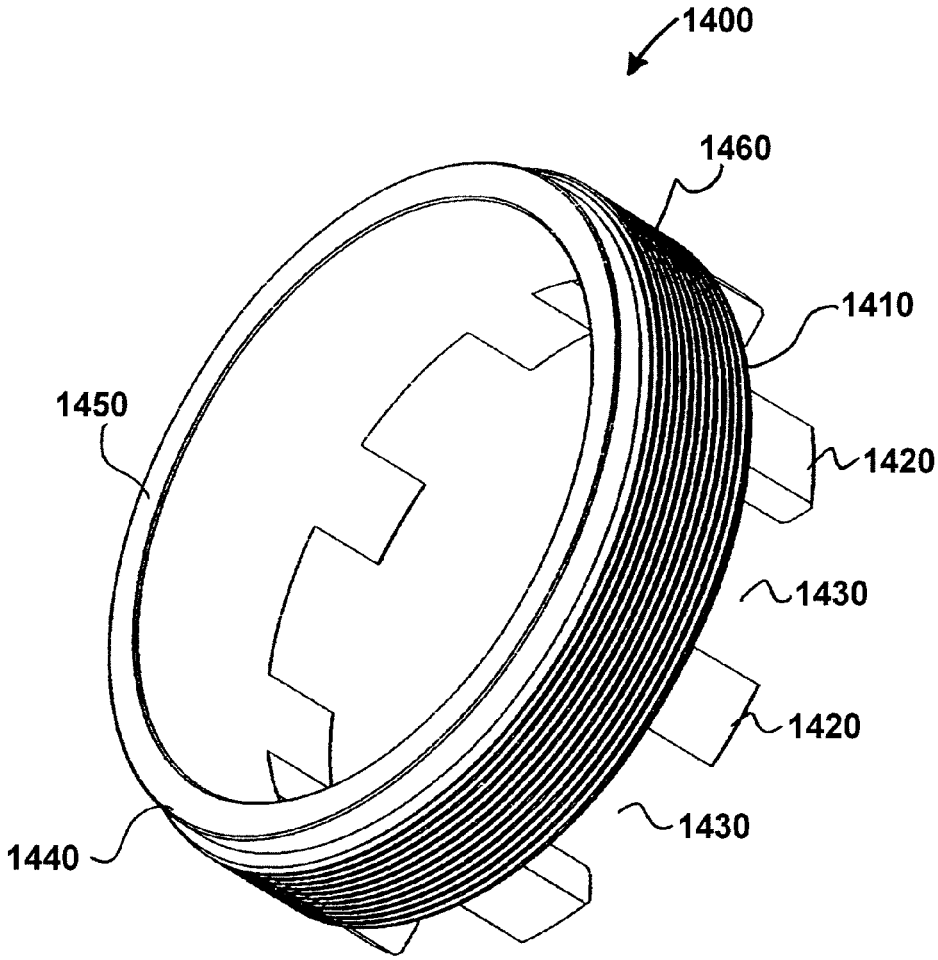
FIG. 10 is a perspective view of a packing nut for the bearing and packing assembly shown in FIG. 5.

FIG. 10 is a perspective view of packing retainer nut 1400. Packing retainer nut 1400 can comprise first end 1410, second end 1440, base 1450, and threaded area. Plurality of tips 1420 and plurality of recessed areas 1430 can be on first end 1410.

Figure 11:
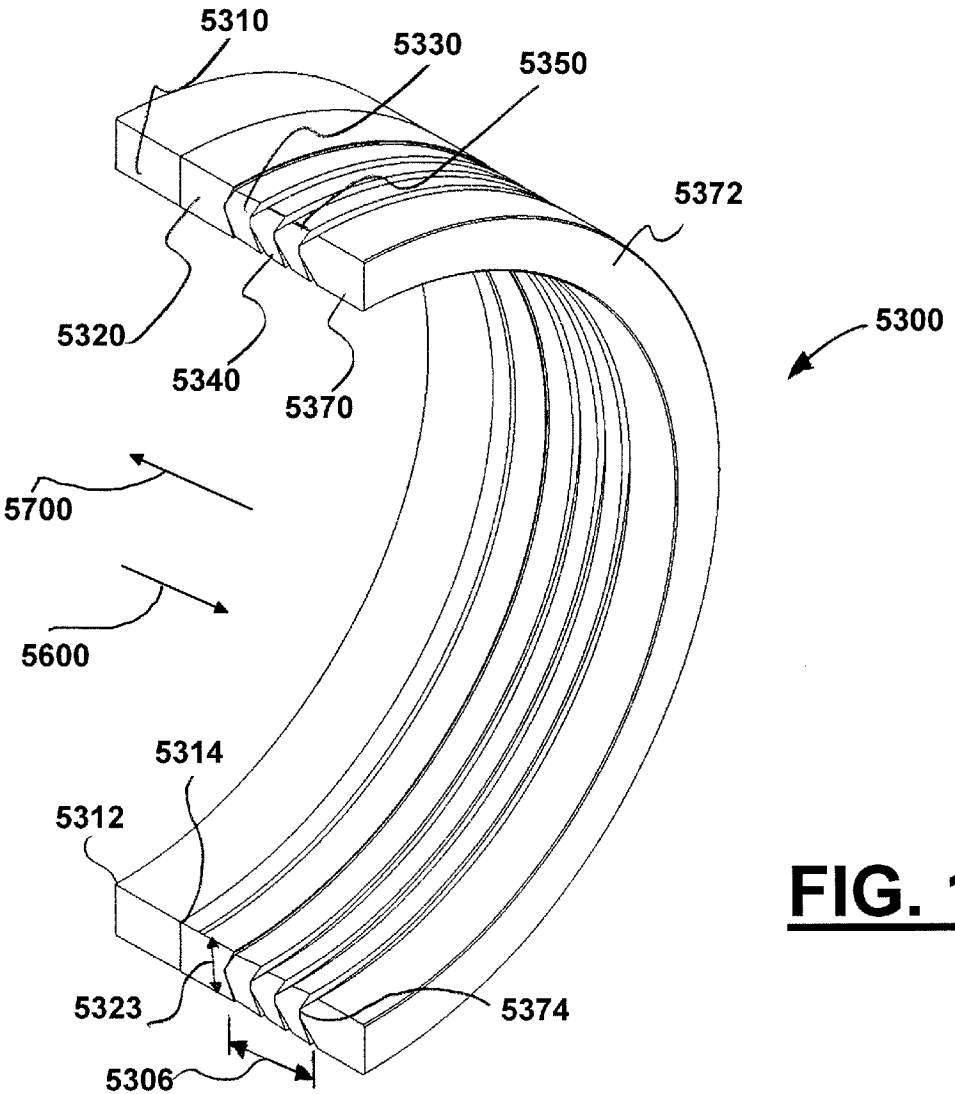
FIG. 11 is a sectional perspective view of a packing unit for the upper portion of the swivel of FIG. 5.

FIG. 11 is a perspective view of one embodiment of a packing unit 5300 (and plurality of seals 5306) is set up to block fluid flow in the direction of arrow 5700, but not block fluid flow in the opposite direction (i.e., arrow 5600). In one embodiment sealing against fluid pressure in the direction of arrow 5700 is much greater than sealing against fluid pressure in the opposite direction (e.g., 1.5 times greater, 2, 3, 4, 5, 6, 7, 8, 9, 10, 20, 30, 40, 50, 60, 70, 80, 90, 100, 1000, and greater, along with any range between these specified factors). Accordingly, fluid (and fluid pressure) can flow through seals 5306 in the direction of arrow 5700 (as schematically shown in FIG. 5) and reach plurality of seals 6302 in the direction of arrows 6700. It is expected that fluid pressure on the pin end of rotating and reciprocating swivel 100 will be higher than pressure on the box end. Therefore, allowing fluid and pressure to flow in the direction of arrow 5600 through plurality of seals 5306 will decrease the net pressure seen by plurality of seals 6302 (the net pressure being the difference between the pressure on the pin end of plurality of seals 6302 and the box end of the plurality of seals 6302). By reducing the net pressure to be sealed against, the expected life of seals 6302 is extended, and the expected frictional resistance created by seals 6302 is reduced. Furthermore, the pressure from fluid in the interstitial space between sleeve or housing 300 and mandrel 110 reduces the net force which sleeve 300 must resist in bending compared to a pressure outside of sleeve 300. Accordingly, the size of sleeve 300 can be reduced based on the lowered net forces it will see.

Additionally, plurality of seals 5306 (in the box end of sleeve 300) and spaced apart from the primary seal set (plurality of seals 6302 on the pin end of sleeve 300), and can serve as a redundant seal set in the event of the failure of the primary seal set 6302. In this case of failure of primary seal set 6302, redundant plurality of seals 5306 will be almost completely a fresh set of seals because plurality of seals 5306 do not start to substantially seal unless and until primary plurality of seals 6302 fails (because there is no net pressure in the direction of arrow 5700 in FIG. 11). Furthermore, even if the primary seal set 6302 fails, backup seal set 5306 will only see a net pressure against which it must seal (the net pressure being the difference between the pressure on the box end of plurality of seals 5306 and the pin end of the plurality of seals 5306).

Additionally, even where primary seal set 6302 fails, the pressure from fluid in the interstitial space between sleeve or housing 300 and mandrel 110 reduces the net force which sleeve 300 must resist in bending compared to an outside pressure on sleeve 300—although now it is expected that the interstitial pressure will be greater than the pressure on the outside of sleeve or housing 300. In the unusual circumstance where the pressure from the box end (in the direction of arrows 5600 and 6700) is greater than the pressure from the pin end (in the direction of arrow 5700), then plurality of seals 6304 will seal against this net pressure in the direction of the pin end.

FIG. 11 is a sectional perspective view showing one embodiment of a packing unit 5300, which can preferably be used in the box end of an alternative embodiment of rotating and reciprocating swivel 100. Packing unit 5300 can comprise male packing ring 5370, plurality of seals 5306, female packing ring 5320, spacer ring 5310, and packing retainer nut 1400 (not shown for clarity). Packing retainer nut 1400 can be threadably connected to end cap 400'. Tightening packing retainer nut 1400 squeezes plurality of seals 5306 between packing housing 1200 and retainer nut 1400 thereby increasing sealing between sleeve 300 and swivel mandrel 110.

Spacer unit 5310 can comprise first end 5312, second end 5314, and is preferably from SAE 660 BRONZE or SAE 954 Aluminum Bronze. Female backup ring (or packing ring) 5320 is preferably comprised of a bearing grade peek material (such as material number 781 supplied by CDI Seals out of Humble, Tex.). Packing ring 5330 is preferable a bronze filled teflon seal (such as material number 714 supplied by CDI Seals out of Humble, Tex.). Packing rings 5340 and 5350 are preferable teflon seals (such as material number 711 supplied by CDI Seals out of Humble, Tex.). Male packing ring 5370 which can comprise first end 5372 and second end 5374 and is preferably machined from SAE 660 BRONZE or SAE 954 Aluminum Bronze with a flat head 5374 and 45 degrees from the vertical. Seals can be Chevron type "VS" packing rings.

Figure 12:
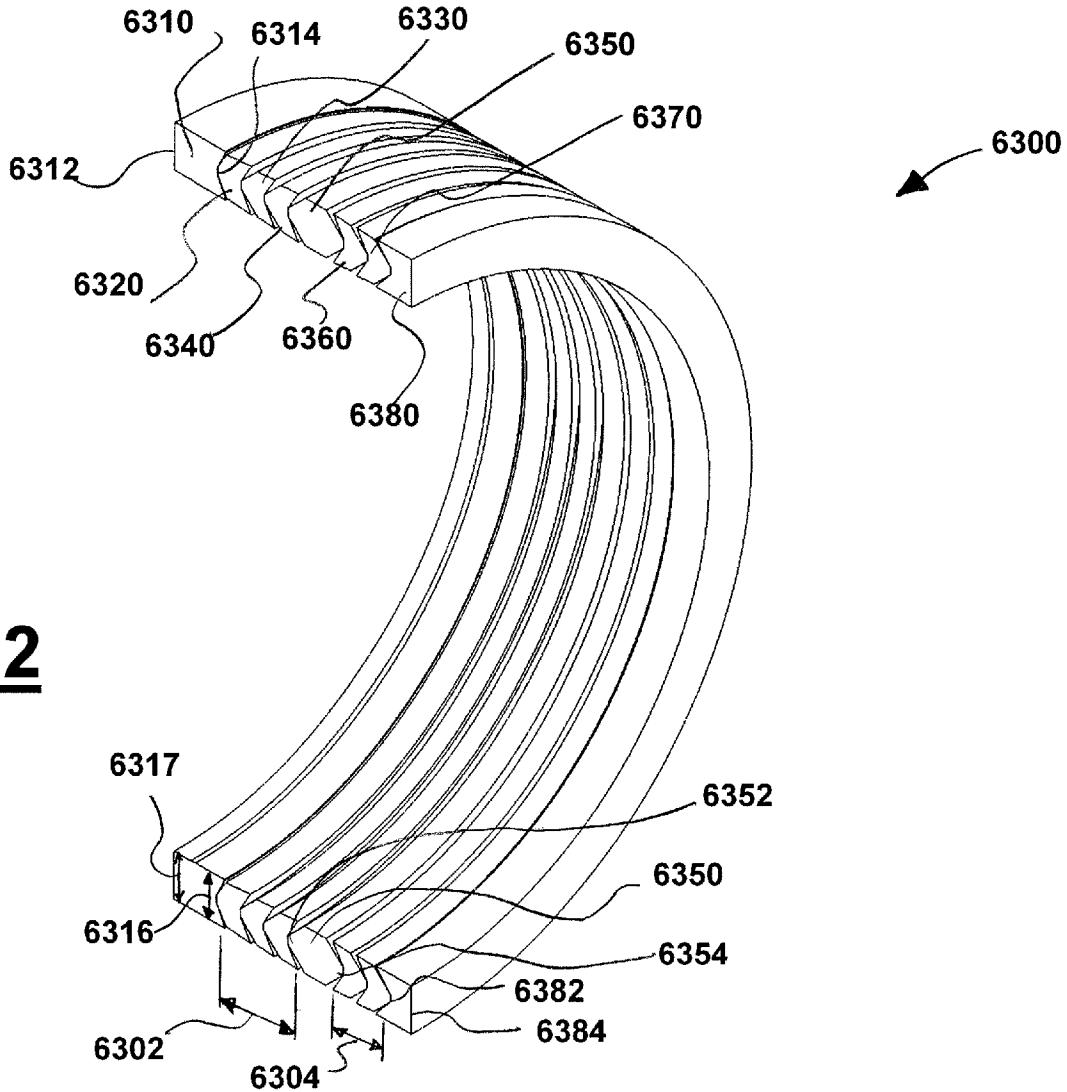
FIG. 12 is a sectional perspective view of the packing unit for the lower portion of the swivel of FIG. 5.

FIG. 12 is a sectional perspective view showing one embodiment for packing unit 6300. Packing unit 6300 can comprise male packing ring 6350, plurality of seals 6302, 6304, female packing rings 6310,6380, male packing ring 6350, and packing retainer nut 1400 (not shown for clarity). Plurality of seals 6302 can seal in the opposite direction of plurality of seals 6304. Packing retainer nut 1400 can be threadably connected to end cap 500'. Tightening packing retainer nut 1400 squeezes plurality of seals 6302,6304 between end cap 500 and retainer nut 1400 thereby increasing sealing between sleeve or housing 300 and swivel mandrel 110.

Female backup ring (or packing ring) 6310 can comprise first end 6312, second end 6314, and is preferably comprised of a bearing grade peek material (such as material number 781 supplied by CDI Seals out of Humble, Tex.). Packing ring 6320 is preferable a bronze filled teflon seal (such as material number 714 supplied by CDI Seals out of Humble, Tex.). Packing rings 6330 and 6340 are preferable teflon seals (such as material number 711 supplied by CDI Seals out of Humble, Tex.). Male packing ring 6350 which can comprise first end 6352 and second end 6354 and is preferably machined from SAE 660 BRONZE or SAE 954 Aluminum Bronze with a flat heads 6353,6355 and both being 45 degrees from the vertical. Packing ring 6360 is preferable comprised of teflon (such as material number 711 supplied by CDI Seals out of Humble, Tex.). Packing ring 6370 is preferable a bronze filled teflon seal (such as material number 714 supplied by CDI Seals out of Humble, Tex.). Female backup ring (or packing ring) 6380 can comprise first end 6382, second end 6384, and is preferably comprised of a bearing grade peek material (such as material number 781 supplied by CDI Seals out of Humble, Tex.). Seals can be Chevron type "VS" packing rings.

While certain novel features of this invention shown and described herein are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

The following is a parts list of reference numerals or part numbers and corresponding descriptions as used herein:

LIST FOR REFERENCE NUMERALS

| Reference Numeral | Description |
|---|---|
| 10 | drilling rig/well drilling apparatus |
| 20 | drilling fluid line |
| 22 | drilling fluid or mud |
| 30 | rotary table |
| 40 | well bore |
| 50 | drill pipe |
| 60 | drill string or well string or work string |
| 70 | annular blowout preventer |
| 71 | annular seal unit |
| 75 | stack |
| 80 | riser |
| 85 | upper drill or work string |
| 86 | lower drill or work string |
| 87 | seabed |
| 88 | well head |
| 90 | upper volumetric section |
| 92 | lower volumetric section |
| 94 | displacement fluid |
| 96 | completion fluid |
| 100 | swivel |
| 110 | mandrel |
| 113 | arrow |
| 114 | arrow |
| 115 | arrow |
| 116 | arrow |
| 117 | arrow |
| 118 | arrow |
| 120 | upper end |
| 130 | lower end |
| 135 | fluted area |
| 136 | plurality of recessed areas |
| 137 | angled area or thrust shoulder |
| 138 | angled area (radial alignment) |
| 140 | box connection |
| 150 | pin connection |
| 160 | central longitudinal passage |
| 162 | connection between upper and lower end |
| 164 | connection from upper end (pin) |
| 166 | connection from lower end (box) |
| 168 | seal |
| 170 | seal |

-continued

LIST FOR REFERENCE NUMERALS

| Reference Numeral | Description |
|---|---|
| 180 | H—length allowed for movement by sleeve or housing over mandrel |
| 200 | pin end sub |
| 210 | upper |
| 212 | seal |
| 214 | back-up ring |
| 216 | back-up ring |
| 220 | lower |
| 250 | recessed area |
| 252 | gap |
| 260 | shoulder |
| 270 | arrow |
| 271 | arrow |
| 272 | arrow |
| 273 | arrow |
| 274 | arrow |
| 275 | arrow |
| 300 | swivel sleeve or housing |
| 302 | upper end |
| 304 | lower end |
| 310 | interior section |
| 311 | upper lubrication port |
| 312 | lower lubrication port |
| 315 | gap |
| 322 | check valve |
| 324 | check valve |
| 326 | upper catch, shoulder, flange |
| 328 | lower catch, shoulder, flange |
| 331 | upper base |
| 332 | upper radiused area |
| 341 | lower base |
| 342 | lower radiused area |
| 350 | L1—overall length of sleeve or housing with attachments on upper and lower ends |
| 360 | L2—length between upper and lower catches, shoulders, flanges |
| 370 | shoulder |
| 372 | recessed area |
| 373 | seal |
| 374 | recessed area |
| 375 | seal |
| 380 | shoulder |
| 382 | recessed area |
| 383 | seal |
| 384 | recessed area |
| 385 | seal |
| 400 | upper retainer cap |
| 405 | plurality of ribs |
| 420 | tip of retainer cap |
| 430 | base of retainer cap |
| 450 | recessed area |
| 460 | plurality of bolt holes |
| 470 | first plurality of bolts |
| 472 | second plurality of bolts |
| 474 | spacer ring |
| 500 | lower retainer cap |
| 510 | upper surface of retainer cap |
| 520 | tip of retainer cap |
| 530 | base of retainer cap |
| 540 | housing |
| 541 | first plurality of fasteners |
| 542 | first plurality of openings |
| 543 | second plurality of fasteners |
| 544 | second plurality of openings |
| 550 | first end |
| 552 | recessed area |
| 560 | second end |
| 562 | recessed area |
| 570 | bearing or thrust hub |
| 572 | first end |
| 574 | second end |
| 576 | plurality of tips and recessed areas |
| 578 | angled section |
| 590 | cover |
| 592 | first end |
| 594 | second end |

-continued

LIST FOR REFERENCE NUMERALS

| Reference Numeral | Description |
|---|---|
| 595 | recessed area |
| 596 | plurality of openings |
| 598 | exterior angled section |
| 599 | beveled section |
| 600 | plurality of openings for shear pins |
| 610 | plurality of shear pins |
| 611 | plurality of tips |
| 612 | plurality of snap rings |
| 614 | adhesive |
| 620 | arrow |
| 630 | arrow |
| 640 | arrow |
| 650 | arrow |
| 660 | arrow |
| 670 | arrow |
| 680 | arrow |
| 700 | joint of pipe |
| 710 | upper portion |
| 720 | lower portion |
| 730 | enlarged area |
| 740 | frustoconical area |
| 750 | protruding section |
| 800 | saver sub |
| 1000 | bearing and packing assembly |
| 1100 | bearing |
| 1110 | outer surface |
| 1120 | inner surface |
| 1122 | inner diameter |
| 1130 | first end |
| 1140 | second end |
| 1150 | opening |
| 1160 | pathway |
| 1180 | recessed areas |
| 1182 | inserts |
| 1190 | plurality of recessed areas |
| 1192 | base |
| 1200 | packing housing |
| 1210 | first end |
| 1220 | second end |
| 1230 | plurality of tips |
| 1240 | first opening |
| 1242 | perimeter recess |
| 1243 | seal (such as polypack) |
| 1250 | second opening |
| 1252 | threaded area |
| 1250 | second opening |
| 1252 | shoulder |
| 1300 | packing stack |
| 1305 | packing unit |
| 1310 | spacer |
| 1312 | first end of spacer |
| 1314 | second end of spacer |
| 1316 | enlarged section of spacer |
| 1320 | female packing end ring |
| 1322 | plurality of seals |
| 1326 | plurality of grooves |
| 1330 | packing ring |
| 1340 | packing ring |
| 1350 | packing ring |
| 1360 | packing ring |
| 1370 | male packing ring |
| 1372 | first end of male packing ring |
| 1374 | second end of male packing ring |
| 1400 | packing retainer nut |
| 1410 | first end |
| 1420 | plurality of tips |
| 1430 | plurality of recessed areas |
| 1440 | second end |
| 1450 | base |
| 1460 | threaded area |
| 1500 | end cap |
| 1510 | first end |
| 1520 | plurality of openings |
| 1530 | second end |
| 1540 | plurality of tips |
| 1550 | plurality of recessed areas |

-continued

LIST FOR REFERENCE NUMERALS

| Reference Numeral | Description |
|---|---|
| 1560 | mechanical seal |
| 1580 | dummy pipe |
| 1590 | testing plate |
| 1596 | radial injection port |
| 1592 | seal |
| 1594 | seal |
| 1598 | arrow |
| 2300 | swivel sleeve or housing |
| 2302 | upper end |
| 2304 | lower end |
| 2310 | interior section |
| 2311 | upper lubrication port |
| 2312 | lower lubrication port |
| 2315 | gap |
| 2322 | check valve |
| 2324 | check valve |
| 2326 | upper catch, shoulder, flange |
| 2328 | lower catch, shoulder, flange |
| 2331 | base |
| 2332 | radiused area |
| 2334 | plurality of openings |
| 2341 | base |
| 2342 | radiused area |
| 2344 | plurality of openings |
| 2350 | L1—overall length of sleeve or housing with attachments on upper and lower ends |
| 2360 | L2—length between upper and lower catches, shoulders, flanges |
| 2370 | shoulder |
| 2372 | recessed area |
| 2373 | seal |
| 2374 | recessed area |
| 2375 | seal |
| 2380 | shoulder |
| 2382 | recessed area |
| 2383 | seal |
| 2384 | recessed area |
| 2385 | seal |
| 2400 | upper retainer cap |
| 2405 | plurality of ribs |
| 2420 | tip of retainer cap |
| 2430 | base of retainer cap |
| 2450 | recessed area |
| 2460 | plurality of bolt holes |
| 2470 | first plurality of bolts |
| 2472 | second plurality of bolts |
| 2500 | lower retainer cap |
| 2510 | upper surface of retainer cap |
| 2520 | tip of retainer cap |
| 2530 | base of retainer cap |
| 2540 | housing |
| 2541 | first plurality of fasteners |
| 2542 | first plurality of openings |
| 2543 | second plurality of fasteners |
| 2544 | second plurality of openings |
| 2550 | first end |
| 2552 | recessed area |
| 2554 | base of recessed area |
| 2560 | second end |
| 2562 | recessed area |
| 2570 | length between base of recessed area to interior angled section of cover |
| 2590 | cover |
| 2592 | first end |
| 2594 | second end |
| 2595 | recessed area |
| 2596 | plurality of openings |
| 2598 | exterior angled section |
| 2599 | beveled section |
| 2600 | interior angled section |
| 2612 | plurality of snap rings |
| 2614 | adhesive |
| 2620 | arrow |
| 2630 | arrow |
| 2640 | arrow |
| 2650 | arrow |

-continued

LIST FOR REFERENCE NUMERALS

| Reference Numeral | Description |
|---|---|
| 2660 | arrow |
| 2670 | arrow |
| 2680 | arrow |
| 2682 | arrow |
| 2684 | arrow |
| 2700 | joint of pipe |
| 2710 | upper portion |
| 2720 | lower portion |
| 2730 | enlarged area |
| 2740 | frustoconical area |
| 2750 | protruding section |
| 2800 | saver sub |
| 3000 | quick lock/quick unlock system |
| 3100 | first part |
| 3110 | bearing and locking hub |
| 3112 | first end |
| 3114 | second end |
| 3120 | plurality of fingers |
| 3130 | example finger |
| 3140 | tip |
| 3150 | latching area of finger |
| 3160 | base of finger |
| 3170 | length of finger |
| 3172 | arrow |
| 3200 | base |
| 3205 | outer diameter |
| 3210 | inner diameter |
| 3220 | first shoulder or angled section |
| 3260 | second shoulder or angled section |
| 3400 | second part |
| 3410 | latching area |
| 3420 | angled area |
| 3440 | flat area |
| 3460 | recessed area |
| 3600 | clutching member |
| 3610 | plurality of alignment members |
| 3620 | example of alignment member |
| 3630 | arrow shaped portion |
| 3640 | fastener |
| 3650 | plurality of bases for alignment members |
| 3660 | plurality of threaded openings |
| 3670 | example base for alignment member |
| 4000 | generic catches |
| 4010 | base |
| 4020 | connector |
| 4030 | base |
| 4040 | connector |
| 4200 | specialized catch |
| 4202 | arrow |
| 4204 | arrow |
| 4220 | first section |
| 4222 | inner diameter |
| 4224 | rounded area |
| 4226 | second rounded area |
| 4230 | plurality of openings |
| 4232 | inner diameter |
| 4234 | rounded area |
| 4236 | second rounded area |
| 4240 | second section |
| 4242 | interior |
| 4244 | base |
| 4246 | angled section |
| 4248 | second base |
| 4250 | diameter |
| 4252 | angled area |
| 4254 | base |
| 4259 | plurality of openings |
| 4260 | plurality of fasteners |
| 4270 | plurality of washers |
| 4280 | plurality of snap rings |
| 4400 | specialized catch |
| 4402 | arrow |
| 4404 | arrow |
| 4420 | first section |
| 4422 | interior |
| 4424 | base |

-continued

LIST FOR REFERENCE NUMERALS

| Reference Numeral | Description |
|---|---|
| 4426 | angled section |
| 4430 | plurality of openings |
| 4440 | second section |
| 4442 | interior |
| 4444 | base |
| 4446 | angled section |
| 4448 | second base |
| 4450 | plurality of openings |
| 4460 | plurality of fasteners |
| 4470 | plurality of washers |
| 4480 | plurality of snap rings |
| 5000 | rotating and reciprocating swivel |
| 5300 | packing stack |
| 5306 | plurality of seals |
| 5310 | spacer |
| 5312 | first end of spacer |
| 5314 | second end of spacer |
| 5320 | female packing end ring |
| 5323 | enlarged section of female packing ring |
| 5330 | packing ring |
| 5340 | packing ring |
| 5350 | packing ring |
| 5370 | male packing ring |
| 5372 | first end of male packing ring |
| 5374 | second end of male packing ring |
| 5400 | plurality of polypack seals |
| 5410 | polypack seal |
| 5420 | polypack seal |
| 5430 | polypack seal |
| 5440 | polypack seal |
| 5500 | hydrostatic testing port |
| 5600 | arrow |
| 5700 | arrow |
| 5710 | arrow |
| 5720 | arrow |
| 6300 | packing stack |
| 6302 | first plurality of seals |
| 6304 | second plurality of seals |
| 6310 | female packing end ring |
| 6312 | first end of female packing end ring |
| 6314 | second end of female packing end ring |
| 6316 | enlarged section of female packing end ring |
| 6317 | reduced section of female packing end ring |
| 6320 | packing ring |
| 6330 | packing ring |
| 6340 | packing ring |
| 6350 | male packing ring |
| 6352 | first end of male packing ring |
| 6354 | second end of male packing ring |
| 6360 | packing ring |
| 6370 | packing ring |
| 6380 | female packing ring |
| 6382 | first end of female packing ring |
| 6384 | second end of female packing ring |
| 6400 | plurality of polypack seals |
| 6410 | polypack seal |
| 6420 | polypack seal |
| 6430 | polypack seal |
| 6440 | polypack seal |
| 6500 | hydrostatic testing port |
| 6600 | arrow |
| 6610 | arrow |
| 6630 | arrow |
| 6640 | arrow |
| 6700 | arrow |
| 6710 | arrow |
| 6720 | arrow |
| 7000 | thrust bearing |
| 7010 | first end |
| 7020 | second end |
| 7030 | first plurality of openings |
| 7032 | first plurality of fasteners/bolts |
| 7033 | driving portion |
| 7040 | second plurality of openings |
| 7042 | second plurality of fasteners/bolts |
| 7043 | driving portion |

-continued

LIST FOR REFERENCE NUMERALS

| Reference Numeral | Description |
|---|---|
| 7044 | bolt head |
| 7100 | spacer ring |
| 7110 | first end |
| 7120 | second end |
| 7140 | dowel opening |
| 7150 | dowel |
| 7200 | plurality of openings |
| BJ | ball joint |
| BL | booster line |
| CM | choke manifold |
| CL | diverter line |
| CM | choke manifold |
| D | diverter |
| DL | diverter line |
| F | rig floor |
| IB | inner barrel |
| KL | kill line |
| MP | mud pit |
| MB | mud gas buster or separator |
| OB | outer barrel |
| R | riser |
| RF | flow line |
| S | floating structure or rig |
| SJ | slip or telescoping joint |
| SS | shale shaker |
| W | wellhead |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A marine oil and gas well drilling apparatus comprising:

(a) a marine drilling platform;

(b) a drill string that extends between the marine drilling platform and a formation to be drilled, the drill string having a flow bore;

(c) a mandrel having upper and lower end sections and connected to and rotatable with upper and lower sections of the drill string, the mandrel having an external diameter and including a longitudinal passage forming a continuation of a flow bore of the drill string sections;

(d) a sleeve having a longitudinal sleeve passage and an internal diameter, the sleeve being rotatably connected to the mandrel;

(e) an interstitial space between the internal diameter of the sleeve and the external diameter of the mandrel;

(f) wherein the sleeve has a pair of spaced apart end caps which are threadably connected to the sleeve.

2. The marine oil and gas well drilling apparatus of claim 1, wherein packing units are placed adjacent to the end caps and in opposing sealing directions.

3. The marine oil and gas well drilling apparatus of claim 2 wherein the packing units define a seal that moves longitudinally with the sleeve.

4. A method of using a reciprocating swivel in a drill or work string, the method comprising the following steps:

(a) lowering a rotating and reciprocating tool to an annular BOP, the tool comprising a mandrel and a sleeve, the sleeve has a pair of spaced apart end caps which are threadably connected to the sleeve, the sleeve being reciprocable relative to the mandrel and the swivel including a quick lock/quick unlock system which has locked and unlocked states;

(b) after step "a", having the annular BOP close on the sleeve;

(c) after step "b", while the annular BOP is closed on the sleeve, causing relative longitudinal movement between the sleeve and the mandrel and causing the quick lock/quick unlock system to enter an unlocked state;

(d) after step "c", while the annular BOP is closed on the sleeve, performing frac operations below the annular BOP;

(e) after step "d", while the annular BOP is closed on the sleeve, causing relative longitudinal movement between the sleeve and the mandrel and activating the quick lock/quick unlock system.

5. The method of claim 4, wherein in step "a", the sleeve is longitudinally locked relative to the mandrel.

6. The method of claim 4, wherein, after step "b", the sleeve is unlocked longitudinally relative to the mandrel.

7. The method of claim 4, wherein, after step "c", the sleeve is longitudinally locked relative to the mandrel.

8. The method of claim 4, wherein during step "c" operations are performed in the wellbore.

9. The method of claim 4, wherein during step "c" the tool is fluidly connected to a string having a bore and fluid is pumped through at least part of the string's bore.

10. The method of claim 4, wherein during step "f" the tool is fluidly connected to a string having a bore and fluid is pumped through at least part of the string's bore.

11. The method of claim 4, wherein the quick lock/quick unlock system is radially aligned before being activated and in a locked state.

12. The method of claim 4, wherein the quick lock/quick unlock system can rotate relative to the sleeve when activated and in a locked state.

13. The method of claim 4, wherein the sleeve includes at least one catch for restricting relative longitudinal movement between the sleeve and the annular BOP when the annular BOP is sealed on the sleeve.

14. The method of claim 12, wherein the sleeve includes two catches spaced apart on the longitudinal ends of the sleeve.

15. The method of claim 12, wherein the at least one catch includes a detachable attachment, the detachable attachment being configured to mate with the annular BOP.

16. The method of claim 14, wherein the detachable attachment includes two pieces which are detachably connectable to the sleeve.

* * * * *